US011473571B2

(12) United States Patent
Akashi et al.

(10) Patent No.: US 11,473,571 B2
(45) Date of Patent: Oct. 18, 2022

(54) SEALED REFRIGERANT COMPRESSOR AND REFRIGERATION DEVICE

(71) Applicant: Panasonic Appliances Refrigeration Devices Singapore, Singapore (SG)

(72) Inventors: Hironari Akashi, Kusatsu (JP); Kazuhiro Yokota, Kusatsu (JP)

(73) Assignee: Panasonic Appliances Refrigeration Devices Singapore, Singapore (SG)

( * ) Notice: Subject to any disclaimer, the term of this patent is extended or adjusted under 35 U.S.C. 154(b) by 45 days.

(21) Appl. No.: 16/616,043

(22) PCT Filed: May 21, 2018

(86) PCT No.: PCT/JP2018/019478

§ 371 (c)(1),
(2) Date: Nov. 22, 2019

(87) PCT Pub. No.: WO2018/216654

PCT Pub. Date: Nov. 29, 2018

(65) Prior Publication Data

US 2021/0062798 A1 Mar. 4, 2021

(30) Foreign Application Priority Data

May 23, 2017 (JP) ..... JP2017-101891

(51) Int. Cl.
*F04B 39/02* (2006.01)
*F04B 39/00* (2006.01)
(Continued)

(52) U.S. Cl.
CPC ..... *F04B 39/0253* (2013.01); *F04B 39/0094* (2013.01); *F04B 39/122* (2013.01); *F25B 1/02* (2013.01); *F25B 2500/13* (2013.01)

(58) Field of Classification Search
CPC ..... F04B 39/122; F04B 39/0094; F04B 39/0253; F25B 2500/13
See application file for complete search history.

(56) References Cited

U.S. PATENT DOCUMENTS 861,463 A * 7/1907 Hyde ..... F16F 15/32 451/343
2,089,626 A 8/1937 Smith
(Continued)

FOREIGN PATENT DOCUMENTS

CN 103486001 A 1/2014
EP 1246348 A2 10/2002
(Continued)

OTHER PUBLICATIONS

International Search Report and Written Opinion of International Search Authority for International Application No. PCT/JP2018/019478.

(Continued)

*Primary Examiner* — Connor J Tremarche
(74) *Attorney, Agent, or Firm* — JCIP; Joseph G. Chu; Jeremy I. Maynard

(57) ABSTRACT

A sealed refrigerant compressor (10A) accommodates an electric component (20A) and a compression component (30) in a sealed container (11). A crankshaft (40) included in the compression component (30) includes a main shaft part (41) and an eccentric shaft part (42). A main shaft part (41) is secured to a rotor (22A) of the electric component (20A). The rotor (22A) is provided with a balance adjustment means such as a balance hole (27), which adjusts an unbalanced load caused by the structure of the main shaft part (41).

8 Claims, 16 Drawing Sheets

(51) Int. Cl.
*F04B 39/12* (2006.01)
*F25B 1/02* (2006.01)

(56) References Cited

U.S. PATENT DOCUMENTS 4,576,555 A * 3/1986 Ashenfelter ..... F04B 39/0246 417/372
4,644,201 A * 2/1987 Tani ..... F16F 15/32 310/216.004
4,718,830 A 1/1988 Middleton et al.
5,435,702 A * 7/1995 Koyama ..... H02K 7/04 417/902
6,917,137 B2 * 7/2005 Okamoto ..... F16F 15/32 310/261.1
2006/0013706 A1 * 1/2006 Ishida ..... F04B 39/0246 417/386
2008/0136280 A1 * 6/2008 Hsiao ..... H02K 7/04 310/114
2013/0140938 A1 * 6/2013 Kaiser ..... H02K 7/04 310/216.117
2013/0328439 A1 12/2013 Okada et al.
2014/0265717 A1 * 9/2014 Boxberg ..... H02K 17/16 310/216.117
2016/0294251 A1 10/2016 Fukasaku et al.

FOREIGN PATENT DOCUMENTS

JP H04112652 A 4/1992
JP 2005-273482 A 10/2005
JP 2007-239635 A 9/2007
JP 2013-087685 A 5/2013
JP 2014-018051 A 1/2014
JP 2016-075260 A 5/2016

OTHER PUBLICATIONS

Supplementary European Search Report for European Application No. EP18806750.
First Office Action for Chinese Application No. 201880034600.6.

* cited by examiner

SEALED REFRIGERANT COMPRESSOR AND REFRIGERATION DEVICE

TECHNICAL FIELD

The present invention relates to a reciprocating sealed refrigerant compressor which compresses a refrigerant by reciprocating a piston inside a cylinder, and a refrigeration device including this sealed refrigerant compressor.

BACKGROUND ART

In a reciprocating refrigerant compressor, an electric component and a compression component are accommodated in a sealed container, and lubricating oil is reserved in the sealed container. The lubricating oil is reserved in a lower region of the sealed container. The compression component includes a cylinder and a piston. In a case where a vertical direction of the sealed container is a longitudinal direction, the cylinder and the piston are disposed in a lateral direction (direction perpendicular to the vertical direction). The electric component causes the piston to perform a reciprocating motion in the cylinder, and thus the compression component compresses the refrigerant.

In the reciprocating refrigerant compressor, reduction of a vibration has been demanded conventionally. In recent years, further reduction of a vibration and reduction of a size of the compressor have been demanded. In the reciprocating refrigerant compressor, since the compression component includes the cylinder and the piston which are disposed in the lateral direction as described above, an unbalanced load tends to occur in the lateral direction due to the reciprocating motion of the piston. This unbalanced load is a main cause of a vibration of the refrigerant compressor.

Conventionally, as a means for mitigating (reducing or cancelling) the unbalanced load, it is known that a balance weight is mounted on the compression component or the electric component. The compression component includes a crankshaft whose main shaft part is supported by a bearing unit of a cylinder block. It is known that the balance weight is mounted on this crankshaft. The electric component includes a stator and a rotor. It is known that the balance weight is mounted on an upper or lower surface of the rotor.

For example, Patent Literature 1 discloses that a balance weight is secured to an eccentric shaft part of the crankshaft, and an end plate integrated with a weight part including a rolling member having a portion bent at a right angle is provided at the end surface of the rotor of the electric component. In accordance with this configuration, the unbalanced load can be lessened by the balance weight and the weight part. In addition, since the weight part is integrated with the end plate, assembling work can be more easily performed and the number of constituents (members) is not increased.

The crankshaft includes an oil feeding mechanism in addition to the main shaft part and the eccentric shaft part. A combination of the main shaft part and a bearing unit or a combination of the eccentric shaft part and a coupling means (connecting rod) form slide parts, respectively. The oil feeding mechanism feeds the lubricating oil reserved in the lower region of the sealed container to the slide parts to lubricate them. As disclosed in, for example, Patent Literature 2, in a typical example, the oil feeding mechanism includes a first oil feeding passage, an oil feeding groove, a second oil feeding passage, and the like.

The first oil feeding passage is a hole extending upwardly from the lower end portion of the main shaft part. The first oil feeding passage is inclined with respect to the center axis (rotation axis center) of the main shaft part. The upper end of the first oil feeding passage is in communication with the spiral oil feeding groove formed in the outer side surface of the main shaft part. The second oil feeding passage is provided over the entire region from the main shaft part to the eccentric shaft part. The second oil feeding passage is in communication with the spiral oil feeding groove.

The lubricating oil reserved in the sealed container is suctioned up into the first oil feeding passage by a centrifugal force caused by the rotation of the crankshaft, fed to the oil feeding groove, and then fed to the second oil feeding passage through the oil feeding groove. The lubricating oil having been fed to the oil feeding groove lubricates the slide part formed by the main shaft part and the bearing unit. The lubricating oil having been fed to the second oil feeding passage lubricates the slide part formed by the coupling means and the eccentric shaft part. The first oil feeding passage is provided inside the main shaft part as the inclined hole as described above. Thus, the lubricating oil can be easily suctioned up by the centrifugal force generated by the rotation of the crankshaft.

CITATION LIST

Patent Literature

Patent Literature 1: Japanese-Laid Open Patent Application Publication No. 2013-087685

Patent Literature 2: Japanese-Laid Open Patent Application Publication No. 2016-075260

SUMMARY OF INVENTION

Technical Problem

In recent years, in the sealed refrigerant compressor, reduction of a vibration is more demanded than in the conventional example.

In a case where the oil feeding passage provided at the lower end portion of the main shaft part is the inclined hole as disclosed in Patent Literature 2, this may cause an unbalanced load in the main shaft part. The unbalanced load in the main shaft part which occurs due to the oil feeding passage is much smaller than the unbalanced load which occurs due to the reciprocating motion of the piston. For this reason, this was not conventionally considered as a cause of an increased vibration of the refrigerant compressor. However, it has been proved that the unbalanced load caused by the structure of the main shaft part should be lessened (reduced or cancelled) to meet a need for further reduction of a vibration in recent years.

The present invention has been developed to solve the above described problem, and an object of the present invention is to provide a reciprocating sealed refrigerant compressor which can lessen the unbalanced load in the main shaft part to realize further reduction of a vibration.

Solution to Problem

To solve the above-described problem, a sealed refrigerant compressor of the present invention comprises: a sealed container in which lubricating oil is reserved in a lower portion inside the sealed container; an electric component accommodated in the sealed container; and a compression component accommodated in the sealed container and configured to be driven by the electric component, wherein the compression component includes: a crankshaft including a main shaft part and an eccentric shaft part, a cylinder disposed inside the sealed container and extending in a direction crossing a vertical direction, and a piston coupled to the eccentric shaft part and being reciprocatable inside the cylinder, wherein the electric component includes: a stator, and a rotor to which the main shaft part is secured, wherein the rotor is provided with a balance adjustment means which adjusts an unbalanced load caused by a structure of at least the main shaft part.

In accordance with this configuration, the unbalanced load occurring in the main shaft part of the crankshaft due to the structure of the main shaft part is not adjusted at the main shaft part or the crankshaft but is adjusted by providing the balance adjustment means at the rotor secured to the main shaft part. The rotor has a cylindrical shape or a circular column shape extending in a direction perpendicular to the axial direction of the crankshaft. Compared to a case where the balance adjustment means is provided at the crankshaft or the main shaft part which is elongated and has a small cross-section (diameter), the balance adjustment means can be easily provided at the rotor, and the location of the balance adjustment means in the rotor can be finely adjusted. Thus, in the whole of the compressor body, the unbalanced load occurring in the main shaft part can be effectively lessened (reduced or cancelled). As a result, further reduction of a vibration of the sealed refrigerant compressor can be realized.

The present invention includes a refrigeration device including the sealed refrigerant compressor with the above-described configuration. This can provide a sealed refrigerant compressor which can realize further reduction of a vibration.

Advantageous Effects of Invention

With the above-described configuration, the present invention provides a reciprocating sealed refrigerant compressor which can lessen an unbalanced load in a main shaft part to realize further reduction of a vibration.

DESCRIPTION OF EMBODIMENTS

Figure 1:
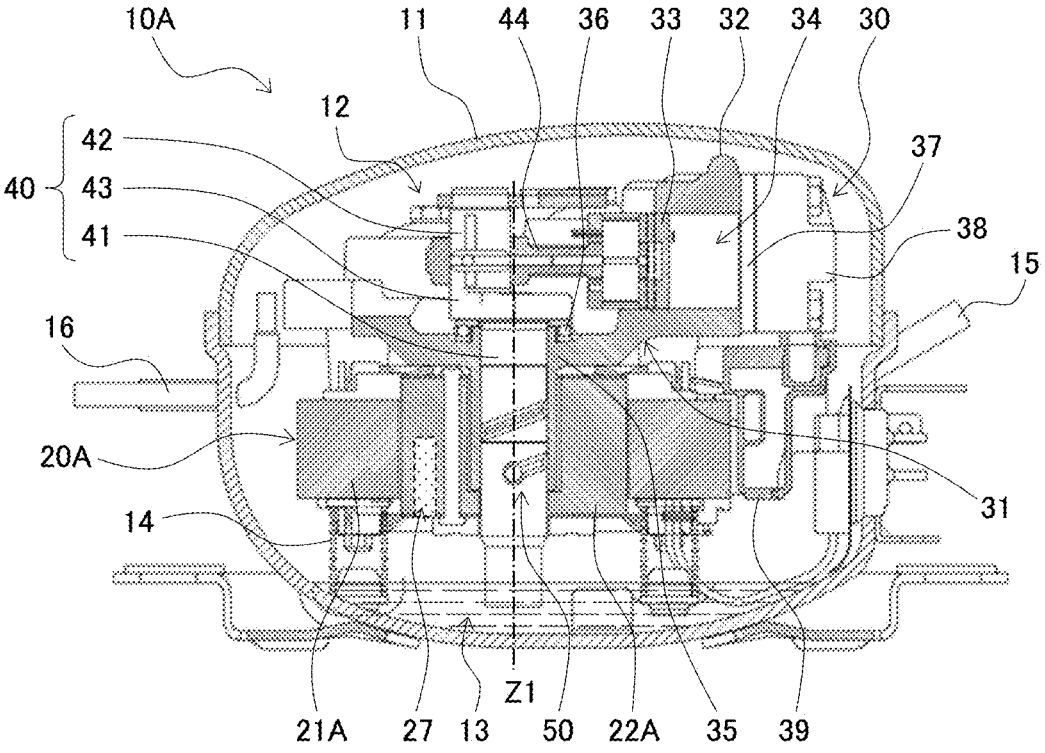
FIG. 1 is a cross-sectional view showing an example of the configuration of a sealed refrigerant compressor according to Embodiment 1 of the present disclosure.

A sealed refrigerant compressor of the present disclosure comprises: a sealed container in which lubricating oil is reserved in a lower portion inside the sealed container; an electric component accommodated in the sealed container; and a compression component accommodated in the sealed container and configured to be driven by the electric component, wherein the compression component includes: a crankshaft including a main shaft part and an eccentric shaft part, a cylinder disposed inside the sealed container and extending in a direction crossing a vertical direction, and a piston coupled to the eccentric shaft part and being reciprocatable inside the cylinder, wherein the electric component includes: a stator, and a rotor to which the main shaft part is secured, wherein the rotor is provided with a balance adjustment means which adjusts an unbalanced load caused by a structure of at least the main shaft part.

In accordance with this configuration, the unbalanced load occurring in the main shaft part of the crankshaft due to the structure of the main shaft part is not adjusted at the main shaft part or the crankshaft but is adjusted by providing the balance adjustment means at the rotor secured to the main shaft part. The rotor has a cylindrical shape or a circular column shape extending in a direction perpendicular to the axial direction of the crankshaft. Compared to a case where the balance adjustment means is provided at the crankshaft or the main shaft part which is elongated and has a small cross-section (diameter), the balance adjustment means can be easily provided at the rotor, and the location of the balance adjustment means in the rotor can be finely adjusted. Thus, in the whole of the compressor body, the unbalanced load occurring in the main shaft part can be effectively lessened (reduced or cancelled). As a result, further reduction of a vibration of the sealed refrigerant compressor can be realized.

In the sealed refrigerant compressor with the above-described configuration, the balance adjustment means may be at least one of a balance hole and a balance weight which are provided at the rotor.

In accordance with this configuration, the balance hole which adjusts a balance by partially reducing the weight of the rotor or the balance weight which adjusts a balance by partially increasing the weight of the rotor is used as the balance adjustment means. Therefore, the unbalanced load occurring in the main shaft part can be more effectively lessened.

In the sealed refrigerant compressor with the above-described configuration, the compression component may further include a bearing unit supporting the main shaft part, and the crankshaft may further include an oil feeding mechanism, the oil feeding mechanism may include an oil feeding passage which is in communication with a lower end surface of the main shaft part, and a position of center of mass of the oil feeding passage is deviated from a center axis of the main shaft part, and in a case where the balance adjustment means is the balance hole, the balance adjustment means may be provided in a semicircular column region of the rotor which is located on a side opposite to the position of center of mass of the oil feeding passage with respect to the center axis of the main shaft part which is located between the balance hole and the position of center of mass of the oil feeding passage.

In accordance with this configuration, the location where the balance adjustment means is provided at the rotor is set within the region (semicircular column region) on the side opposite to the position of center of mass of the oil feeding passage, with respect to the center axis of the main shaft part which is located between the balance adjustment means and the position of center of mass of the oil feeding passage. This makes it possible to more effectively lessen the unbalanced load occurring in the main shaft part.

In the sealed refrigerant compressor with the above-described configuration, in a case where a radial line extending from a rotation axis of the rotor through a position of center of mass of the eccentric shaft part is a reference line of 0 degree, and an angle formed in a region on a side opposite to the position of center of mass of the oil feeding passage is a positive angle, the balance adjustment means may be provided within a sector column region in a range of 5 to 175 degrees with respect to the reference line, in the semicircular column region of the rotor.

In accordance with this configuration, the location where the balance adjustment means is provided at the rotor is set within the sector column region included in the semicircular column region. This makes it possible to more effectively lessen the unbalanced load occurring in the main shaft part.

In the sealed refrigerant compressor with the above-described configuration, the balance adjustment means may be provided within at least one of a sector column region in a range of 5 to 40 degrees with respect to the reference line and a sector column region in a range of 140 to 175 degrees with respect to the reference line, in the semicircular column region of the rotor.

In accordance with this configuration, the location where the balance adjustment means is provided at the rotor is set within at least one of the two sector column regions included in the above sector column region. This makes it possible to more effectively lessen the unbalanced load occurring in the main shaft part.

In the sealed refrigerant compressor with the above-described configuration, the balance hole may be provided in an iron core of the rotor.

In accordance with this configuration, since the balance hole is provided in the iron core of the rotor, the balance hole with a simpler configuration can be provided more flexibly, depending on a state of the unbalanced load. This makes it possible to properly adjust the balance of the load in the rotor.

In the sealed refrigerant compressor with the above-described configuration, the balance hole may extend along a direction of a rotation axis of the rotor.

In accordance with this configuration, since the balance hole is provided to extend along the direction of the rotation axis of the rotor, the balance of the load in the rotor can be properly adjusted.

In the sealed refrigerant compressor with the above-described configuration, the balance hole may be a blind hole with a bottom surface or a through-hole.

In accordance with this configuration, since the balance of the load is adjusted by adjusting the depth of the balance hole, the balance of the load in the rotor can be properly adjusted.

In the sealed refrigerant compressor with the above-described configuration, the balance adjustment means may adjust an unbalanced load generated by a reciprocating motion of the piston in addition to the unbalanced load caused by the structure of the main shaft part.

In accordance with this configuration, the balance adjustment means is provided at a suitable location of the semicircular column region or the sector column region to adjust the unbalanced load generated by the reciprocating motion of the piston in addition to the unbalanced load caused by the structure of the main shaft part. This makes it possible to effectively lessen the unbalanced load in the whole of the sealed refrigerant compressor.

The present disclosure includes a refrigeration device comprising the sealed refrigerant compressor with the above-described configuration. Thus, it becomes possible to provide a sealed refrigerant compressor which can realize further reduction of a vibration.

Hereinafter, exemplary embodiments of the present disclosure will be described with reference to the accompanying drawings. Throughout the drawings, the same or corresponding components are designated by the same reference symbols, and will not be described in repetition.

Embodiment 1

First of all, a typical example of the configuration of the sealed refrigerant compressor according to the present disclosure will be described with reference to FIGS. 1 and 2.

Example of Configuration of Sealed Refrigerant Compressor

Referring to FIG. 1, a sealed refrigerant compressor 10A according to Embodiment 1 includes an electric component 20A and a compression component 30 which are accommodated in a sealed container 11, and a refrigerant gas and lubricating oil 13 are reserved in the sealed container 11. The electric component 20A and the compression component 30 constitute a compressor body 12. The compressor body 12 is disposed inside the sealed container 11 in a state in which the compressor body 12 is elastically supported by a suspension spring 14 provided on the bottom portion of the sealed container 11.

The sealed container 11 is provided with a suction pipe 15 and a discharge pipe 16. The first end of the suction pipe 15 is in communication with the inner space of the sealed container 11, and the second end thereof is connected to a refrigeration device (not shown), thus constituting a refrigeration cycle such as a refrigerant circuit. The first end of the discharge pipe 16 is connected to the compression component 30, and the second end thereof is connected to the refrigeration device. As will be described later, the refrigerant gas having been compressed by the compression component 30 is led to a refrigerant circuit through the discharge pipe 16, while the refrigerant gas from the refrigerant circuit is led to the inner space of the sealed container 11 through the suction pipe 15.

The specific configuration of the sealed container 11 is not particularly limited. In the present embodiment, the sealed container 11 is manufactured by, for example, drawing of an iron plate. The refrigerant gas is reserved in the sealed container 11 in a relatively low temperature state and at a pressure which is substantially equal to that on a low-pressure side in the refrigerant circuit including the sealed refrigerant compressor 10A. The lubricating oil 13 is reserved in the sealed container 11 and lubricates a crankshaft 40 (which will be described later) included in the compression component 30. As shown in FIG. 1, the lubricating oil 13 is reserved in the bottom portion of the sealed container 11.

The kind of the refrigerant gas is not particularly limited. The refrigerant gas known in the field of the refrigeration cycle is suitably used. In the present embodiment, for example, R600a which is a hydrocarbon based refrigerant gas is suitably used. R600a has a relatively low global warming potential (GNP). For the purpose of protection of global environments, R600a is one of refrigerant gases suitably used. The kind of the lubricating oil 13 is not particularly limited. The lubricating oil known in the field of the compressor is suitably used.

As shown in FIG. 1, the electric component 20A includes at least a stator 21A and a rotor 22A. The stator 21A is secured to the lower side of a cylinder block 31 (which will be described later) included in the compression component 30 by use of a fastener member such as a bolt (not shown). The rotor 22A is disposed inward of the stator 21A and coaxially with the stator 21A. The rotor 22A is configured to secure a main shaft part 41 of the crankshaft 40 (which will be described later) included in the compression component 30 by, for example, shrinkage fitting.

The stator 21A includes a plurality of windings (not shown). The rotor 22A includes a plurality of permanent magnets (not shown) corresponding to the plurality of windings, respectively. As shown in FIG. 1, in the present embodiment, the permanent magnets are embedded in an iron core which is a body of the rotor 22A. Therefore, the electric component 20A is an IPM (interior permanent magnet rotor) motor. The rotor 22A is disposed inward of the stator 21A. Therefore, the electric component 20A of the present embodiment is an inner rotor type motor.

The rotor 22A is rotatable around a center axis Z1 extending along a longitudinal direction indicated by one-dotted line in FIG. 1. The lower surface of the rotor 22A faces the oil surface of the lubricating oil 13. The upper surface of the rotor 22A faces a bearing unit 35 which is a portion of a cylinder block 31 (described later). As shown in FIG. 1, the rotor 22A is provided with a balance hole 27 as a balance adjustment means. The specific configuration of the rotor 22A including the balance holes 27 will be described later. The electric component 20A including the stator 21A and the rotor 22A is connected to an external inverter drive circuit (not shown), and inverter-driven with one of a plurality of operating frequencies.

The compression component 30 is driven by the electric component 20A and is configured to compress the refrigerant gas. In the present embodiment, as shown in FIG. 1, the compression component 30 is accommodated in the sealed container 11 and located above the electric component 20A. As shown in FIG. 1, the compression component 30 includes the cylinder block 31, a cylinder 32, a piston 33, a compression chamber 34, the bearing unit 35, the crankshaft 40, a thrust bearing 36, a valve plate 37, a cylinder head 38, a suction muffler 39, etc.

The cylinder block 31 is provided with the cylinder 32 and the bearing unit 35. The cylinder 32 is disposed to extend in a direction crossing a vertical direction, and fastened to the bearing unit 35. More specifically, when the vertical direction is a longitudinal direction and a horizontal direction (direction perpendicular to the vertical direction) is a lateral direction, in a state in which the sealed refrigerant compressor 10A is placed on a horizontal plane, the cylinder 32 is disposed to extend in the lateral direction inside the sealed container 11. As will be described later, the bearing unit 35 supports the main shaft part 41 of the crankshaft 40 so that the main shaft part 41 is rotatable. The cylinder 32 is secured to the bearing unit 35 and located outward of the main shaft part 41.

A bore having a substantially cylindrical shape with a diameter that is substantially equal to that of the piston 33 is provided inside the cylinder 32. The piston 33 is reciprocatingly inserted into the bore. The cylinder 32 and the piston 33 define a compression chamber 34. The refrigerant gas is compressed in the compression chamber 34. The bearing unit 35 supports the main shaft part 41 of the crankshaft 40 so that the main shaft part 41 is rotatable.

The crankshaft 40 is supported inside the sealed container 11 so that the axis of the crankshaft 40 extends in the longitudinal direction. As shown in FIG. 2, the crankshaft 40 includes the main shaft part 41, an eccentric shaft part 42, a flange part 43, a connecting rod 44, an oil feeding mechanism 50, etc. As described above, the main shaft part 41 of the crankshaft 40 is secured to the rotor 22A of the electric component 20A. The eccentric shaft part 42 is eccentric with respect to the main shaft part 41. The flange part 43 integrally connects the eccentric shaft part 42 and the main shaft part 41 to each other. A thrust bearing 36 is provided between the flange part 43 and the bearing unit 35.

The bearing unit 35 provided at the cylinder block 31 supports the main shaft part 41 of the crankshaft 40 so that the main shaft part 41 is rotatable. Therefore, the outer peripheral surface of the main shaft part 41 and the inner peripheral surface of the bearing unit 35 are slide surfaces. The thrust bearing 36 is provided at the upper surface of the bearing unit 35. The flange part 43 of the crankshaft 40 is provided at the upper surface of the thrust bearing 36. During the rotation of the main shaft part 41, the flange part 43 also rotates. The rotation of flange part 43 is supported by the thrust bearing 36.

The connecting rod 44 is a coupling member (coupling means) coupling the eccentric shaft part 42 of the crankshaft 40 to the piston 33. As will be described later, the rotation of the crankshaft 40 is transmitted to the piston 33 via the connecting rod 44. As shown in FIG. 2, the oil feeding mechanism 50 is provided so that the lower end of the main shaft part 41 immersed in the lubricating oil 13 is connected to the upper end of the eccentric shaft part 42. The oil feeding mechanism 50 feeds the lubricating oil 13 to the crankshaft 40, the bearing unit 35, the thrust bearing 36, and the like. The specific configuration of the oil feeding mechanism 50 will be described later.

As described above, the piston 33 inserted into the cylinder 32 is coupled to the connecting rod 44. The axis of the piston 33 crosses the axial direction of the crankshaft 40. Although in the present embodiment, the crankshaft 40 is disposed so that its center axis extends in the longitudinal direction, the piston 33 is disposed so that its center axis extends in the lateral direction. Therefore, the axial direction of the piston 33 is perpendicular (orthogonal) to the axial direction of the crankshaft 40.

As described above, the connecting rod 44 couples the eccentric shaft section 42 and the piston 33 to each other. By the rotation of the main shaft part 41, the flange part 43 and the eccentric shaft part 42 rotate. The rotational motion of the crankshaft 40 rotated by the electric component 20A is transmitted to the piston 33 via the connecting rod 44. This allows the piston 33 to reciprocate inside the cylinder 32.

As described above, the piston 33 is inserted into the first end portion (on the crankshaft 40 side) of the cylinder 32. The second end portion (away from the crankshaft 40) is closed by a valve plate 37 and a cylinder head 38. The valve plate 37 is located between the cylinder 32 and the cylinder head 38. The valve plate 37 is provided with a suction valve (not shown) and a discharge valve (not shown). The cylinder head 38 is formed with a discharge space therein. The refrigerant gas from the compression chamber 34 is discharged into the discharge space of the cylinder head 38 when the discharge valve of the valve plate 37 is opened. The cylinder head 38 is in communication with the suction pipe 15.

The suction muffler 39 is located on a lower side in the interior of the sealed container 11, from the perspective of the cylinder 32 and the cylinder head 38. The suction muffler 39 has a muffling space therein. The suction muffler 39 is in communication with the compression chamber 34 via the valve plate 37. When the suction valve of the valve plate 37 is opened, the refrigerant gas inside the suction muffler 39 is suctioned into the compression chamber 34.

Figure 2:
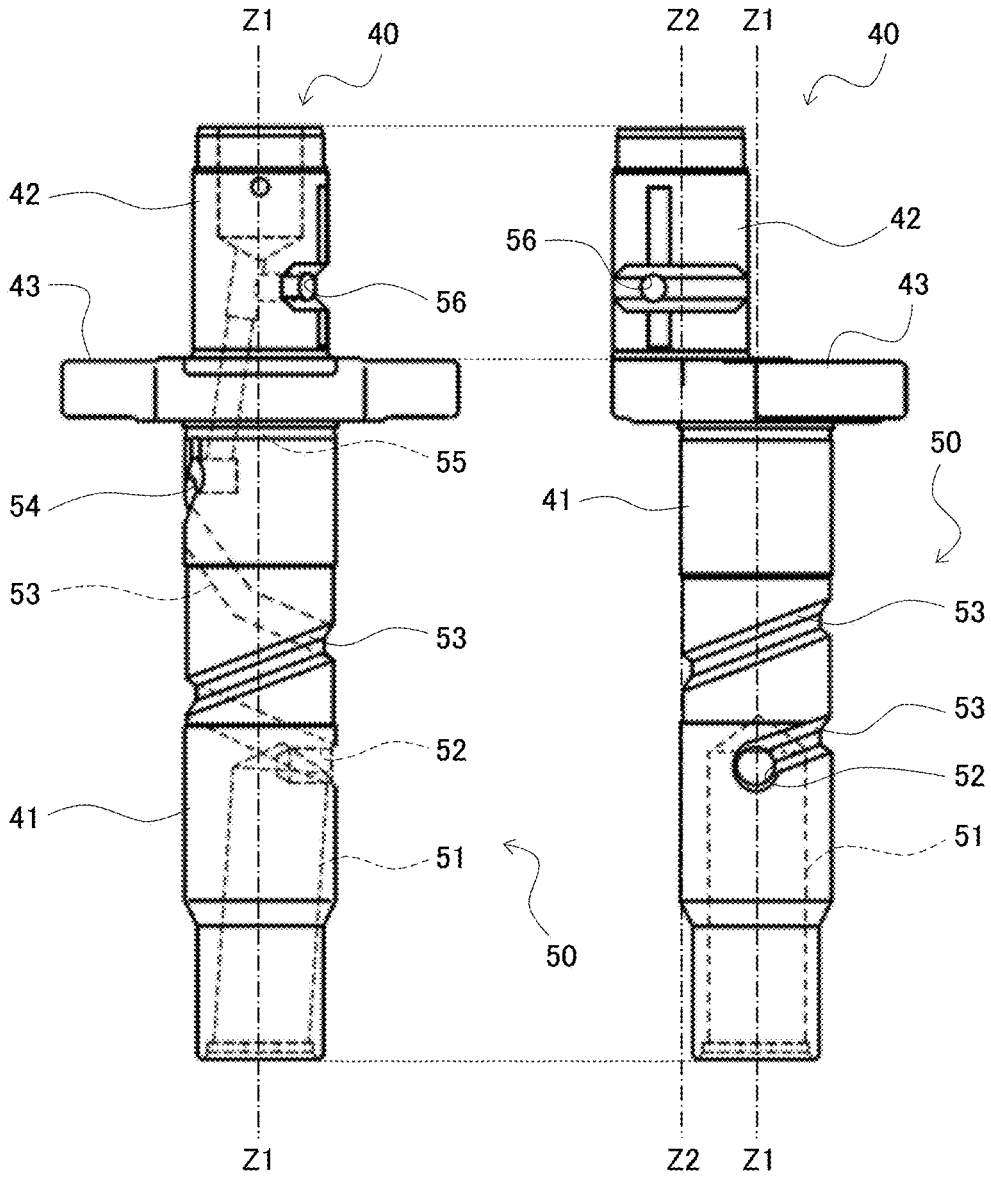
FIG. 2 is a view showing an example of the configuration of a crankshaft included in the sealed refrigerant compressor of FIG. 1, and showing a comparison between different side surfaces.

Although not explicitly shown in FIGS. 1 and 2, a balance weight may be mounted on the crankshaft 40 to lessen (reduce or cancel) an unbalanced load generated by the reciprocation motion of the piston 33. Specifically, for example, a crank weight may be mounted on the upper end of the crankshaft 40, to be precise, the upper end of the eccentric shaft part 42, or a shaft weight may be mounted on the flange part 43.

Example of Configuration of Oil Feeding Mechanism

Next, a typical example of the configuration of the oil feeding mechanism 50 provided at the crankshaft 40 will be described with reference to FIG. 2.

As shown in FIG. 2, the oil feeding mechanism 50 includes a first oil feeding passage 51, a first communication hole 52, an oil feeding groove 53, an oil feeding hole 54, a second oil feeding passage 55, a second communication hole 56, and others. In FIG. 2, a left-side view (left view) is a side view in which the center axis Z1 of the main shaft part 41 and the center axis Z2 of the eccentric shaft part 42 conform to each other, and the crankshaft 40 is seen from a direction in which the eccentric shaft part 42 is on a near side in the direction of the drawing sheet (the main shaft part 41 is on a far side in the direction of the drawing sheet), and a right-side view (right view) is a side view in which the crankshaft 40 is seen from a direction in which the center axis Z1 of the main shaft part 41 and the center axis Z2 of the eccentric shaft part 42 are most distant from each other.

For easier understanding of the description, in a case where a direction (lengthwise direction) in which the crankshaft 40 extends is referred to as "vertical direction", a direction in which the main shaft part 41 and the eccentric shaft part 42 are arranged is referred to as "longitudinal direction" of the crankshaft 40, and a direction which is perpendicular (orthogonal) to this longitudinal direction and in which the arrangement of the main shaft part 41 and the eccentric shaft part 42 can be seen is referred to as "lateral direction" of the crankshaft 40, the left view of FIG. 2 is a longitudinal side view of the crankshaft 40 and the right view of FIG. 2 is a lateral side view of the crankshaft 40.

The longitudinal side view (left view) of FIG. 2 shows the crankshaft 40 from the side surface in which the eccentric shaft part 42 is located on a near side in the drawing sheet, in the longitudinal direction. For easier description of the drawings, a side where the eccentric shaft part 42 is on the near side in the longitudinal direction is referred to "front side", and a side (opposite to the side where the eccentric shaft part 42 is located on the near side in the longitudinal direction) where the main shaft part 41 is located in the longitudinal direction on the near side is referred to as "rear side".

The lateral side view (right view) of FIG. 2 shows the crankshaft 40 from a side surface where the eccentric shaft part 42 is located on the left side and the main shaft part 41 is located on the right side, in the lateral direction. A side where the eccentric shaft part 42 is located on the left side in the lateral direction will be referred to as "obverse side", and a side (side opposite to the obverse side) where the eccentric shaft part 42 is located on the right side (the main shaft part 41 is located on the left side) will be referred to as "reverse side". In the example of FIG. 2, the rear portion of the flange part 43 extends in the lateral direction (obverse side and reverse side).

As indicated by a broken line of FIG. 2, the first oil feeding passage 51 is provided inside the lower end portion of the main shaft part 41. The first oil feeding passage 51 is formed as a hole extending upward from the end surface of the lower end portion of the main shaft part 41. As shown in the longitudinal side view (left view) of FIG. 2, the first oil feeding passage 51 is inclined with respect to the center axis Z1 of the main shaft part 41. More specifically, the first oil feeding passage 51 is inclined so that the center line of the first oil feeding passage 51 is more distant in the lateral direction from the center axis Z1 as the first oil feeding passage 51 extends upward. In the example of FIG. 2, the first oil feeding passage 51 is inclined to the obverse side (right side in the longitudinal side view). However, this is exemplary. The first oil feeding passage 51 may be inclined to the reverse side (left side in the longitudinal side view), or may not be inclined.

As indicated by a broken line in the longitudinal side view (left view) of FIG. 2 and indicated by a solid line in the lateral side view (right view) of FIG. 2, the first communication hole 52 is provided in communication with the outer side surface of the main shaft part 41 at the upper end of the first oil feeding passage 51. The first communication hole 52 is connected to the oil feeding groove 53 formed in the outer peripheral surface of the main shaft part 41. In this structure, the first oil feeding passage 51 and the oil feeding groove 53 are in communication with each other via the first communication hole 52. In the example of FIG. 2, the first oil feeding passage 51 is inclined to the obverse side, and therefore the first communication hole 52 is in communication with the outer peripheral surface which is the obverse side of the main shaft part 41. This is exemplary.

As shown in FIG. 2, the oil feeding groove 53 is a groove-shaped part formed in a spiral shape in the outer peripheral surface of the main shaft part 41. As described above, the lower end portion (first end) of the oil feeding groove 53 is in communication with the first oil feeding passage 51 via the first communication hole 52. As will be described later, the lubricating oil 13 is fed from the first oil feeding passage 51. Therefore, the first end (end portion closer to the first communication hole 52) is the upstream end of the lubricating oil 13. The upper end portion (second end) of the oil feeding groove 53 reaches the outer peripheral surface of the upper end of the main shaft part 41, i.e., a location that is adjacent to the lower surface of the flange part 43 of the main shaft part 41, and is connected to the oil feeding hole 54. Therefore, the second end (end portion closer to the oil feeding hole 54) of the oil feeding groove 53 is the downstream end of the lubricating oil 13.

In the example of FIG. 2, the oil feeding groove 53 is formed in the spiral shape which is inclined with respect to the center axis Z1 of the main shaft part 41 so that the downstream side extends upward when viewed from the upstream side of the lubricating oil 13. In the longitudinal side view (left view) of FIG. 2, the oil feeding groove 53 located in the outer peripheral surface on the front side which is the near side is indicated by a solid line, while the oil feeding groove 53 located in the outer peripheral surface which is on the rear side opposite to the front side is indicated by a broken line. In contrast, in the lateral side view (right view) of FIG. 2, only the oil feeding groove 53 located in the outer peripheral surface on the obverse side which is the near side is shown, while the oil feeding groove 53 located in the outer peripheral surface which is on the reverse side opposite to the obverse side is not shown. Although in the example of the longitudinal side view of FIG. 2, the oil feeding groove 53 is formed as being wound around the outer peripheral surface of the main shaft part 41 about one and a half times (about 1.6 times), this is exemplary.

As shown in the longitudinal side view (left view) of FIG. 2, as described above, the oil feeding hole 54 is formed in the outer peripheral surface of the upper end of the main shaft part 41 so that the oil feeding hole 54 is connected to the upper end portion of the oil feeding groove 53. The oil feeding hole 54 is in communication with the second oil feeding passage 55. The oil feeding hole 54 is formed as a depressed (recessed) portion with an opening formed in the outer peripheral surface of the main shaft part 41. The opening of the oil feeding hole 54 is connected to the oil feeding groove 53 and the second oil feeding passage 55 is in communication with the upper region of the depressed portion. Although in the example of FIG. 2, the oil feeding hole 54 opens to the reverse side in the outer peripheral surface of the upper end of the main shaft part 41, this is exemplary.

As shown in the longitudinal side view (left view) of FIG. 2, the second oil feeding passage 55 is a pipe-shaped portion extending upward over the inner portion of the eccentric shaft part 42, from the inner portion of the upper end of the main shaft part 41 via the inner portion of the flange part 43. The lower end of the second oil feeding passage 55 is in communication with the oil feeding hole 54, as described above, and the upper end of the second oil feeding passage 55 reaches the upper end of the eccentric shaft part 42. In the example of FIG. 2, the oil feeding hole 54 is formed in the outer peripheral surface which is on the reverse side of the main shaft part 41. Therefore, the second oil feeding passage 55 is inclined in a direction from the reverse side to the obverse side (inclined in the same direction as that of the first oil feeding passage 51). This is exemplary.

The second communication hole 56 is provided in communication with the outer peripheral surface of the eccentric shaft part 42, from a lateral side of the second oil feeding passage 55, which is inside the eccentric shaft part 42. As in the first oil feeding passage 51, in the example of FIG. 2, the second oil feeding passage 55 is inclined in the direction from the reverse side to the obverse side. Therefore, the second communication hole 56 is in communication with the outer peripheral surface of the eccentric shaft part 42, which is on the obverse side. This is exemplary.

Operation of Sealed Refrigerant Compressor

Next, the operation of the sealed refrigerant compressor 10A with the above-described configuration will be specifically described in conjunction with advantages thereof. Although not shown in FIG. 1, the sealed refrigerant compressor 10A includes the suction pipe 15 and the discharge pipe 16 as described above, and the suction pipe 15 and the discharge pipe 16 are connected to the refrigeration device having a well-known configuration, and constitute a refrigerant circuit.

When electric power is supplied from an external power supply to the electric component 20A, a current flows through the stator 21A and a magnetic field is generated, which causes the rotor 22A to rotate. According to the rotation of the rotor 22A, the main shaft part 41 of the crankshaft 40 rotates. The rotation of the main shaft part 41 of the crankshaft 40 is transmitted to the piston 33 via the flange part 43, the eccentric shaft part 42, and the connecting rod 44, and thereby the piston 33 reciprocates inside the cylinder 32. Correspondingly, the refrigerant gas is suctioned, compressed, and discharged inside the compression chamber 34.

The operation of the oil feeding mechanism 50 which is performed at this time will be described specifically. The lubricating oil 13 reserved in the bottom portion of the sealed container 11 is suctioned up into the first oil feeding passage 51 by a centrifugal force generated due to the rotation of the crankshaft 40. The lubricating oil 13 having been suctioned into the first oil feeding passage 51 is fed to the upstream end of the oil feeding groove 53 through the first communication hole 52. By the rotation of the crankshaft 40, the lubricating oil 13 having been fed to the upstream end of the oil feeding groove 53 flows toward the upper end of the main shaft part 41 through the oil feeding groove 53, and reaches the oil feeding hole 54 connected to the downstream end of the oil feeding groove 53.

As described above, the oil feeding groove 53 is formed in the spiral shape wound around the outer peripheral surface of the main shaft part 41. The main shaft part 41 is rotatably inserted into the bearing unit 35. The outer peripheral surface of the main shaft part 41 and the inner peripheral surface of the bearing unit 35 slide by the rotation of the crankshaft 40. Therefore, the lubricating oil 13 flowing through the oil feeding groove 53 lubricates a slide part formed by the main shaft part 41 and the bearing unit 35.

Since the oil feeding hole 54 is in communication with the second oil feeding passage 55, the lubricating oil 13 having reached the oil feeding hole 54 is fed to the second oil feeding passage 55. Since the oil feeding hole 54 is in communication with the outer peripheral side of the second oil feeding passage 55, a part of the lubricating oil 13 having reached the oil feeding hole 54 is fed to the outer peripheral surface of the upper end side of the main shaft part 41 and lubricates this outer peripheral surface. Further, a part of the lubricating oil 13 having been fed to the outer peripheral surface of the upper end side of the main shaft part 41 can be fed to the lower surface of the flange part 43 located on the upper side of the main shaft part 41 by a known configuration. Therefore, this part of the lubricating oil 13 can lubricate the thrust bearing 36 located between the flange part 43 and the bearing unit 35.

The lubricating oil 13 having been fed to the second oil feeding passage 55 flows through the second oil feeding passage 55 and reaches the upper end of the eccentric shaft part 42. A part of the lubricating oil 13 flowing through the second oil feeding passage 55 is fed from the second communication hole 56 to the connecting rod 44. The inner peripheral surface of the connecting rod 44 and the outer peripheral surface of the eccentric shaft part 42 are the slide surfaces. A part of the lubricating oil 13 having been fed from the second communication hole 56 lubricates the slide part formed by the connecting rod 44 and the eccentric shaft part 42. The lubricating oil 13 having reached the upper end of the eccentric shaft part 42 is fed to the cylinder 32 and the piston 33. The lubricating oil 13 lubricates the slide part formed by the cylinder 32 and the piston 33.

Next, suction, compression and discharge of the refrigerant gas inside the compressor 34 will be specifically described. Hereinafter, of directions in which the piston 33 moves inside the cylinder 32, a direction in which the volume of the compression chamber 34 increases will be referred to "increase direction", and a direction in which the volume of the compression chamber 34 decreases will be referred to "decrease direction." When the piston 33 moves in the increase direction, the refrigerant gas inside the compression chamber 34 is expanded. Then, when a pressure in the compression chamber 34 falls below a suction pressure, the suction valve of the valve plate 37 starts to be opened due to a difference between the pressure in the compression chamber 34 and a pressure in the suction muffler 39.

According to this operation, the refrigerant gas with a low temperature, which has been returned from the refrigeration device, is released to the inner space of the sealed container 11 through the suction pipe 15. Then, the refrigerant gas is introduced into the muffling space of the suction muffler 39. At this time, as described above, the suction valve of the valve plate 37 starts to be opened. Therefore, the refrigerant gas having been introduced into the muffling space of the suction muffler 39 flows into the compression chamber 34. Then, when the piston 33 moves in the decrease direction from a bottom dead center inside the cylinder 32, the refrigerant gas inside the compression chamber 34 is compressed, and the pressure in the compression chamber 34 increases. Also, due to the difference between the pressure in the compression chamber 34 and the pressure in the suction muffler 39, the suction valve of the valve plate 37 is closed.

Then, when the pressure in the compression chamber 34 exceeds a pressure in the cylinder head 38, the discharge valve (not shown) starts to be opened, due to the difference between the pressure in the compression chamber 34 and the pressure in the cylinder head 38. According to this operation, the compressed refrigerant gas is discharged into the cylinder head 38, until the piston 33 reaches a top dead center inside the cylinder 32. Then, the refrigerant gas having been discharged into the cylinder head 38 is sent out to the refrigeration device through the discharge pipe 16.

Then, when the piston 33 moves in the increase direction again from the top dead center inside the cylinder 32, the refrigerant gas inside the compression chamber 34 is expanded, which decreases the pressure in the compression chamber 34. When the pressure in the compression chamber 34 falls below (becomes lower than) the pressure in the cylinder head 38, the discharge valve of the valve plate 37 is closed.

The above-described suction, compression, and discharge strokes are performed in repetition in every rotation of the crankshaft 40, and thus the refrigerant gas is circulated within the refrigeration cycle. A specific driving method of the sealed refrigerant compressor 10A which performs the above-described operation is not particularly limited. Although the sealed refrigerant compressor 10A may be driven by a simple ON/OFF control, it is preferably inverter-driven with any one of a plurality of operating frequencies as described above. In the inverter drive, the control for the operation of the sealed refrigerant compressor 10A can be suitably performed by reducing or increasing the rotation speed of the electric component 20A.

Configuration of Rotor

Next, a balance adjustment means provided at the rotor 22A to adjust an unbalanced load caused by the structure of at least the main shaft part 41, in the sealed refrigerant compressor 10A according to the present embodiment, will be specifically described with reference to FIGS. 3A to 3C and FIG. 4, in addition to FIG. 1.

In the sealed refrigerant compressor 10A according to the present embodiment, as shown in FIGS. 1 and 3A to 3C, the rotor 22A of the electric component 20A is provided with a balance hole 27, as the balance adjustment means. It is sufficient that the balance hole 27 is formed in an iron core which is the body of the rotor 22A and extends along the rotation axis direction of the rotor 22A.

The specific configuration of the balance hole 27 is not particularly limited. In the example shown in FIGS. 3A to 3C, the balance hole 27 is formed as a blind hole with a bottom surface. Alternatively, the balance hole 27 may be formed as a through-hole penetrating (piercing) the rotor 22A (core of the body). In the example shown in FIGS. 3A to 3C, one balance hole 27 is provided. Alternatively, a plurality of balance holes may be provided. Further, as will be described later, the balance adjustment means is not limited to the balance hole 27 so long as the balance adjustment means is capable of adjusting the unbalanced load caused by the structure of at least the main shaft part 41.

Figure 3A:
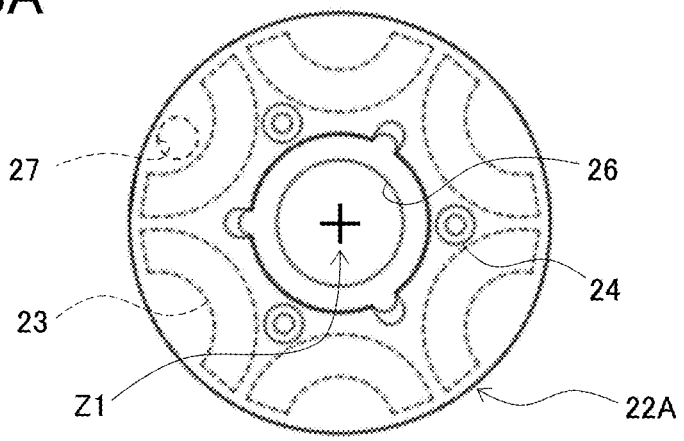
FIGS. 3A to 3C are views showing an example of the configuration of a rotor included in the sealed refrigerant compressor of FIG. 1.
Figure 3B:
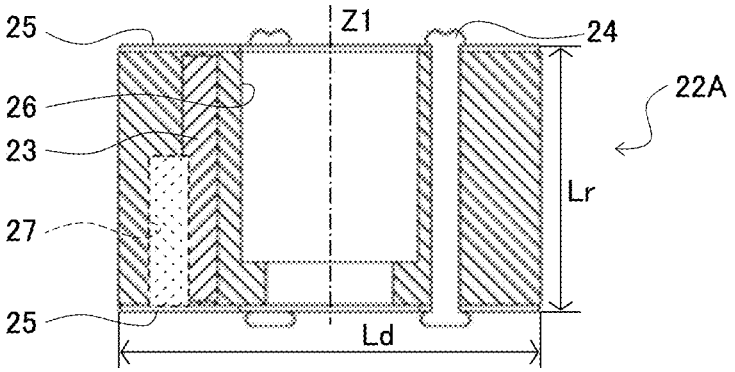
Figure 3C:
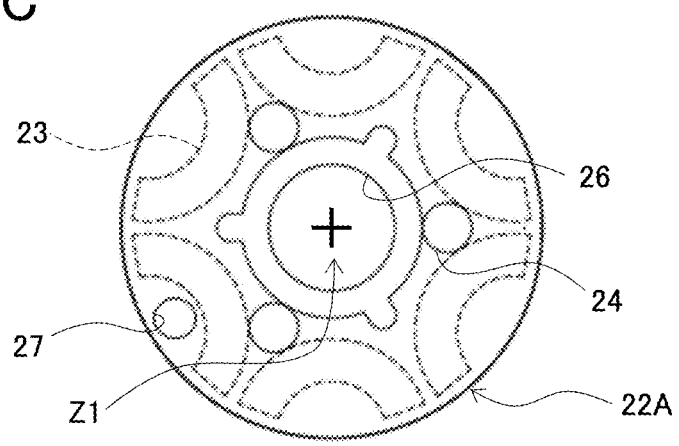

As described above, the rotor 22A according to the present embodiment is the IPM rotor. Therefore, as shown in FIGS. 3A to 3C, permanent magnets 23 are embedded in the iron core which is the body of the rotor 22A. Therefore, in the example of FIGS. 3A and 3C, the balance hole 27 is provided at a location of the iron core which is other than the locations of the embedded permanent magnets 23. In the present embodiment, as indicated by broken lines of FIGS. 3A and 3C, the permanent magnets 23 are entirely embedded in the iron core. In this structure, the rotor 22A does not include magnet protective members covering the outer peripheral surfaces of the permanent magnets 23 (the rotor 22A does not require the magnet protective members for covering the permanent magnets 23).

As shown in FIGS. 3A to 3C, the rotor 22A has a shaft insertion hole 26 at a center thereof. The main shaft part 41 of the crankshaft 40 and the lower end of the bearing unit 35 of the cylinder block 31 are insertable into the shaft insertion hole 26. Therefore, the center line in the extending direction of the shaft insertion hole 26 conforms to the rotation center of the rotor 22A and the center axis Z1 of the main shaft part 41 of the crankshaft 40. FIG. 3A which is the top plan view and FIG. 3C which is the bottom view indicate the center axis Z1 by a cross mark, while FIG. 3B which is the longitudinal sectional view indicates the center axis Z1 by one-dotted line.

As can be seen from FIG. 3B, the shaft insertion hole 26 has a shape in which its upper part and its lower part are different from each other in inner diameter (its upper part and its lower part have different inner diameters). The shaft insertion hole 26 has a stepped part so that a portion of the bearing unit 35 into which the main shaft part 41 is inserted is inserted into the upper part of the shaft insertion hole 26, and only the main shaft part 41 is inserted into the lower part of the shaft insertion hole 26. As shown in FIG. 1, the bearing unit 35 constitutes the lower part of the cylinder block 31. In the present embodiment, the bearing unit 35 extends in the lateral direction over the entire sealed container 11. The center portion of the bearing unit 35 has a cylindrical shape protruding in a downward direction. The upper part of the main shaft part 41 is inserted into the center portion of the bearing unit 35. Therefore, the shaft insertion hole 26 has a shape in which the diameter of the upper part is greater than that of the lower part. In this structure, the upper part of the shaft insertion hole 26 supports the cylindrical portion of the bearing unit 35 (and the main shaft part 41 inserted into the cylindrical portion of the bearing unit 35), and the lower part of the shaft insertion hole 26 supports only the main shaft part 41 inserted into the shaft insertion hole 26.

The iron core constituting the body of the rotor 22A has a configuration in which a plurality of electromagnetic steel plates (thin iron plates) with a disc shape are stacked together (laminated). To integrate the plurality of electromagnetic steel plates into the iron core, fastening members penetrating (piercing) the rotor 22A along the direction of the center axis Z1 direction as shown in FIGS. 1 and 3B. In the present embodiment, as shown in FIGS. 3A to 3C, the plurality of electromagnetic steel plates are integrated together by use of caulking pins 24. The plurality of electromagnetic steel plates are formed with caulking holes, respectively, into which the caulking pins 24 are inserted.

As shown in FIG. 3B, end plates 25 are provided on the upper surface and lower surface of the rotor 22A, respectively. The end plates 25 are integrally secured together with the iron core by use of the caulking pins 24. As shown in FIG. 3B, in a case where the balance hole 27 is provided in the iron core, the opening may be formed in the end plate 25 located at the lower surface of the rotor 22A. Thus, the balance hole 27 is formed as the blind hole which has a bottom surface at an upper side and opens in the lower surface of the rotor 22A.

The specific shape of the rotor 22A is not particularly limited. In the present embodiment, as shown in FIG. 3B, the length of the rotor 22A in the diameter direction (horizontal direction) is preferably larger than that in the rotation axis direction (vertical direction). In other words, the rotor 22A has a shape in which the diameter Ld is larger than the axial length Lr. For example, as shown in FIG. 3B, when the length of the rotor 22A in the direction of the rotation axis is Lr, and the diameter of the rotor 22A is Ld, the length Lr is smaller than the diameter Ld (Lr<Ld).

The location at which the balance adjustment means is provided at the rotor 22A is not particularly limited so long as the unbalanced load of at least the main shaft part 41 can be lessened (reduced or cancelled). Typically, the balance adjustment means is provided at a location based on the position of center of mass (weighted center or center of gravity) of the first oil feeding passage 51, which is one main cause of the unbalanced load of the main shaft part 41.

As described above, the first oil feeding passage 51 is inclined with respect to the center axis Z1 of the main shaft part 41 (see longitudinal side view of FIG. 2). This causes occurrence of the unbalanced load in the main shaft part 41. In the conventional example, this unbalanced load is negligible. To meet the demand of further reduction of a vibration in recent years, it is necessary to lessen the unbalanced load caused by the first oil feeding passage 51 to a minimum level. In a case where the rotor 22A is provided with the balance adjustment means, it is necessary to consider the position of center of mass of at least a space (hollow) part which is the first oil feeding passage 51.

The crankshaft 40 includes the eccentric shaft part 42 which is different in center axis from the main shaft part 41, in addition to the main shaft part 41. To lessen the unbalanced load of the main shaft part 41, it is necessary to consider the position of center of mass of the eccentric shaft part 42, as well as the position of center of mass of the first oil feeding passage 51.

Further, as described above, the balance weight is mounted on the crankshaft 40 to lessen the unbalanced load caused by the reciprocation motion of the piston 33. Therefore, to lessen the unbalanced load of the main shaft part 41, it is necessary to consider the position of center of mass of this balance weight.

It is supposed that the position of center of mass of the first oil feeding passage 51 is "oil feeding passage mass center W1", the position of center of mass of the eccentric shaft part 42 is "eccentric shaft part mass center W2", and the location of the balance weight mounted on the crankshaft 40 is "weight mass center W3". In this case, as indicated by X marks in FIG. 4, the eccentric shaft part mass center W2 and the weight mass center W3 are located on a straight line together with the rotation axis of the rotor 22A, namely, the center axis Z1 of the main shaft part 41, while the oil feeding passage mass center W1 is deviated from this straight line.

In a case where a direction in which the oil feeding passage mass center W1 is located with respect to the center axis Z1 is D1 direction, a direction in which the eccentric shaft part mass center W2 is located with respect to the center axis Z1 is D2 direction, and a direction in which the weight mass center W3 is located with respect to the center axis Z1 is D3 direction, lines extending in the D2 direction and the D3 direction conform to the diameter of the rotor 22A, and the D1 direction is substantially orthogonal (perpendicular) to this diameter. In a case where the rotor 22A is divided into two parts along the vertical direction (center axis Z1 direction), the oil feeding passage mass center W1 is located in one of semicircular column regions which are the two parts.

Figure 4:
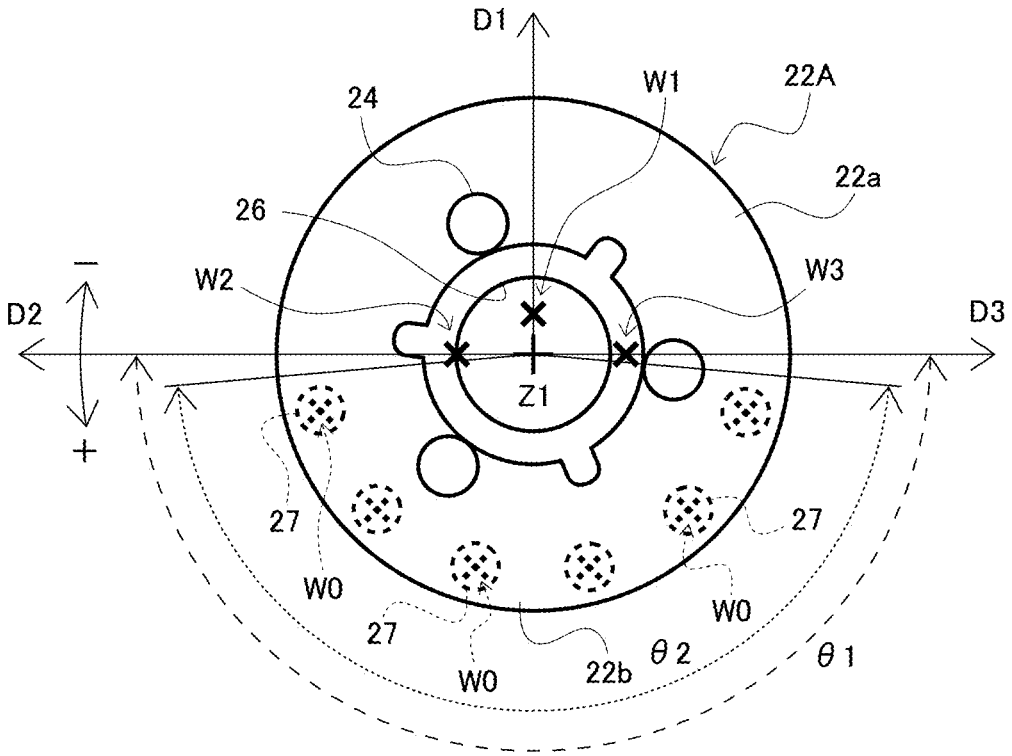
FIG. 4 is a schematic view showing the locations of balance holes which are an example of a balance adjustment means provided at the rotor of FIGS. 3A to 3C.

Therefore, the balance adjustment means is provided in the other of the semicircular column regions, rather than one of the semicircular column regions where the oil feeding passage mass center W1 is located. In the example of FIG. 4, for easier description, one of the semicircular column regions where the oil feeding passage mass center W1 is located is referred to as "mass center side semicircular column region 22*a*", and the other semicircular column region where the balance adjustment means is provided will be referred to as "adjustment side semicircular column region 22*b*".

In the example of FIG. 4, the balance adjustment means is the balance hole 27. The oil feeding passage mass center W1 is located in the mass center side semicircular column region 22*a* on the upper side in FIG. 4 (To be precise, since the oil feeding passage mass center W1 is located within the main shaft part 41, the oil feeding passage mass center W1 is located within the shaft insertion hole 26 of the rotor 22A in FIG. 4). As indicated by dotted-line of FIG. 4, the balance hole 27 is provided at any location in the adjustment side semicircular column region 22*b* on the lower side in FIG. 4.

The balance hole 27 (the balance adjustment means) is provided at a location in the adjustment side semicircular column region 22*b* of the rotor 22A which is on a side opposite to the oil feeding passage mass center W1 with respect to the center axis Z1 (the center axis Z1 disposed between the oil feeding passage mass center W1 and the location of the balance hole 27 in the adjustment side semicircular column region 22*b*).

The adjustment side semicircular column region 22*b* can be expressed as an angular range with respect to the rotation axis (center axis Z1 of the main shaft part 41) of the rotor 22A. Specifically, in a case where a radial line extending from the rotation axis (center axis Z1) of the rotor 22A through the eccentric shaft part mass center W2 is a reference line of 0 degree and an angle formed in a region on a side opposite to the oil feeding passage mass center W1 is a positive angle, the balance adjustment means is in a range of 0 to 180 degrees with respect to the reference line, in the adjustment side semicircular column region 22*b* of the rotor 22A. This reference line conforms to the line extending in the D2 direction.

As described above, the balance weight mounted on the crankshaft 40 is, for example, the crank weight provided at the upper end of the eccentric shaft part 42, or the shaft weight provided at the flange part 43. Thus, there are options of the balance weight. On the other hand, there is no option for the location of the eccentric shaft part 42 with respect to the main shaft part 41. Accordingly, in the present embodiment, the line extending in the D2 direction on which the eccentric shaft part mass center W2 is located, of the D2 direction and the D3 direction corresponding to the diameter of the rotor 22A, is the reference line of 0 degree.

The balance hole 27 (balance adjustment means) is provided in the adjustment side semicircular column region 22*b* (lower side in FIG. 4) opposite to the mass center side semicircular column region 22*a* (upper side in FIG. 4) where the oil feeding passage mass center W1 is located. Therefore, the angle formed in a range of the adjustment side semicircular column region 22*b* with respect to the reference line of 0 degree extending in the D2 direction is a positive (plus) angle. Note that an angle formed in a range of the mass center side semicircular column region 22*a* with respect to the reference line is a negative (minus) angle. Therefore, the location of the balance hole 27 is within the semicircular column region (adjustment side semicircular column region 22*b*) in a range of 0 to 180 degrees in the rotor 22A. In FIG. 4, this angular range is indicated by a broken-line bidirectional arrow θ1 (0 degree≤θ1≤180 degrees).

A preferable region where the balance hole 27 is provided may be a narrower region rather than the whole of the adjustment side semicircular column region 22*b*. In the conventional example, the oil feeding passage mass center W1 is ignored. Therefore, it is sufficient that the eccentric shaft part mass center W2 and the weight mass center W3 are considered, of the three mass centers in FIG. 4. For example, in a case where the weight mass center W3 of the two mass centers is the cause of the unbalanced load and the balance hole 27 is provided as the balance adjustment means to lessen this unbalanced load, the location of the balance hole 27 is on the straight line extending in the D2 direction, namely, the location of 0 degree. In a case where the eccentric shaft part mass center W2 of the two mass centers is the cause of the unbalanced load, the location of the balance hole 27 is on the straight line extending in the D3 direction, namely, the location of 180 degrees.

However, in the present disclosure, the oil feeding passage mass center W1 which was ignored in the past should be considered. Although the location of the balance hole 27 is varied depending on the state of the unbalanced load to be adjusted by the balance hole 27, the location of the balance hole 27 is preferably a little deviated from a location that is near 0 degree or 180 degrees, toward a region opposite to the oil feeding passage mass center W1.

In view of this, as indicated by a dotted line bidirectional arrow θ2 in FIG. 4, the balance hole 27 (balance adjustment means) is preferably provided within a sector column region which is in a range of 5 to 175 degrees (5 degrees≤θ2≤175 degrees) of the adjustment side semicircular column region 22*b* (angular range of 0 to 180 degrees). In other words, the balance hole 27 is preferably provided at a location that is deviated by 5 degrees or more from the location of 0 degree or 180 degrees.

The structure which is the main cause of the unbalanced load occurring in the main shaft part 41 is the first oil feeding passage 51 which is inclined, as described above. In addition, the oil feeding groove 53, the first communication hole 52, and the oil feeding hole 54 provided to be wound around the outer peripheral surface of the main shaft part 41 may be a cause of the unbalanced load. In light of this, the position of the oil feeding passage mass center W1 may be set in view of deviations of the centers of mass (weighted centers or centers of gravity) of the oil feeding groove 53, the first communication hole 52, and the oil feeding hole 54, as well as the center of mass of the first oil feeding passage 51. The balance hole 27 may be provided within the adjustment side semicircular column region 22*b* in view of the center of mass of the first oil feeding passage 51, and the centers of mass of the oil feeding groove 53, the first communication hole 52, and the oil feeding hole 54.

The balance adjustment means such as the balance hole 27 may be provided in the rotor 22A to adjust the unbalanced load caused by the reciprocating motion of the piston 33, in addition to the unbalanced load caused by the structure of the main shaft part 41. The unbalanced load caused by the reciprocating motion of the piston 33 can be lessened by the balance adjustment means provided in the rotor 22A, together with the balance weight provided at the crankshaft 40.

Location of Balance Adjustment Means

Next, a more preferable region where the balance hole 27 is provided in the rotor 22A (the adjustment side semicircular column region 22*b*) based on the location of the balance weight provided at the crankshaft 40 will be described with reference to FIGS. 5 to 12.

Figure 5:
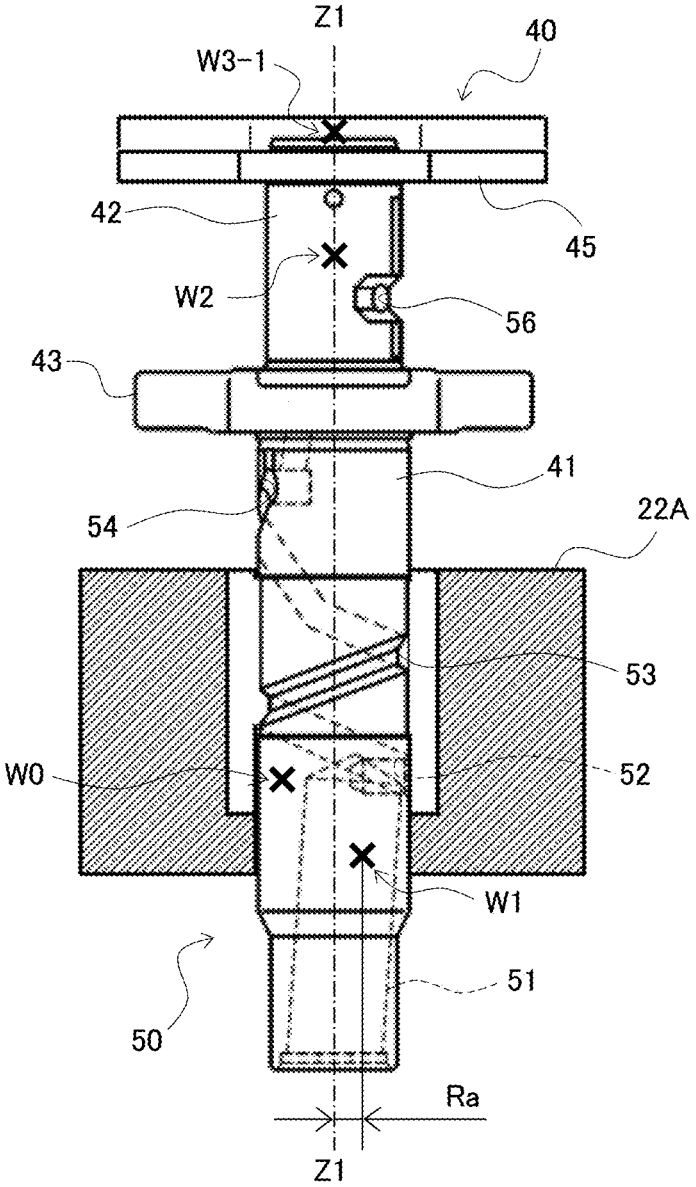
FIG. 5 is a schematic side view showing an example of positions of centers of mass (weighted centers) in the crankshaft of FIG. 2.
Figure 6:
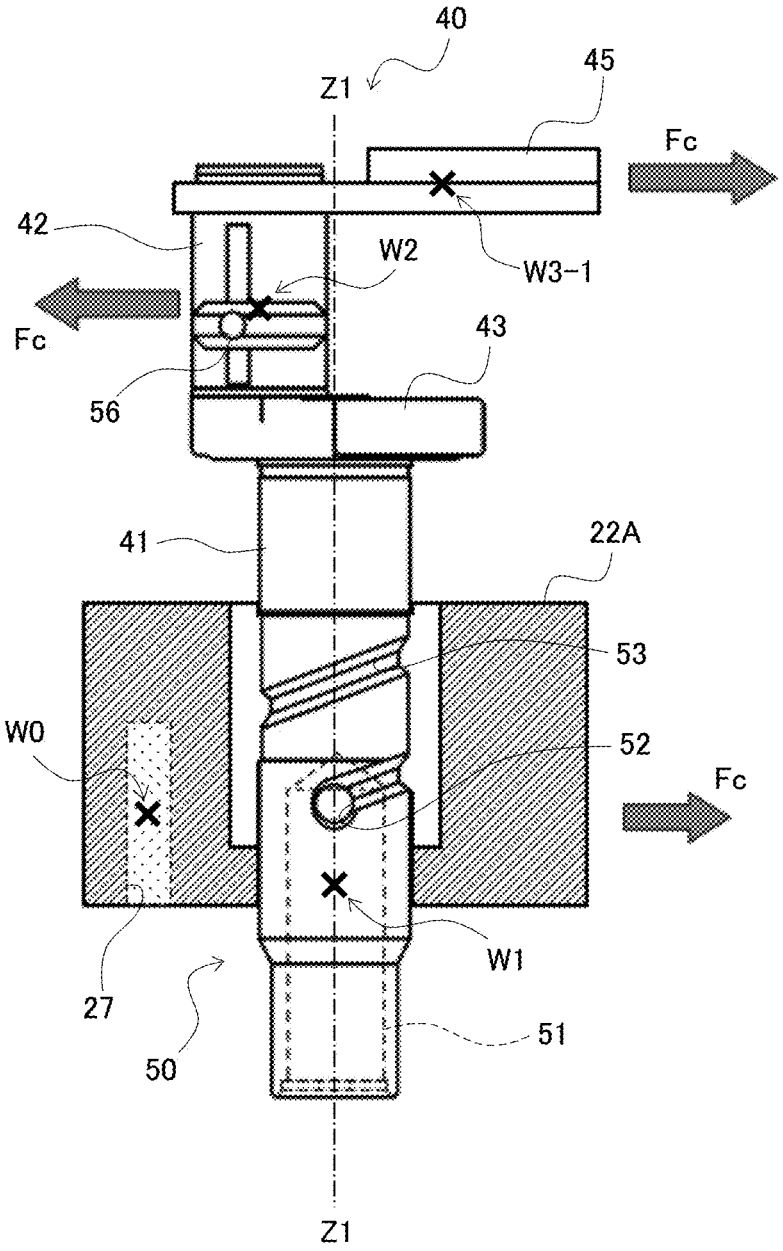
FIG. 6 is a schematic side view showing an example of positions of centers of mass in the crankshaft of FIG. 2.

For example, a more preferable location of the balance hole 27 in a case where the crank weight 45 is provided at the upper end of the eccentric shaft part 42 as the balance weight, as shown in FIG. 5 or 6, will be described. FIG. 5 corresponds to the longitudinal side view (left view) of FIG. 2. FIG. 6 corresponds to the lateral side view (right view) of FIG. 2.

In FIGS. 5 and 6, the schematic cross-section of the rotor 22A secured to the main shaft part 41 is shown. Also, the oil feeding passage mass center W1, the eccentric shaft part mass center W2, and the weight mass center W3 are indicated by X marks, as in the example of FIG. 4. Note that in FIGS. 5 and 6 (and FIG. 7), the weight mass center W3 is expressed as weight mass center W3-1 to make clear that the weight mass center W3 is the position of center of mass of the crank weight 45.

As shown in FIG. 5, in a case where the balance weight is the crank weight 45 provided at the upper portion of the eccentric shaft part 42, the weight mass center W3-1 is located on the center axis Z1 (overlapping with a center axis Z2 of the eccentric shaft part 42) of the main shaft part 41, at the upper side of the eccentric shaft part 42, when viewed from the front side in the longitudinal direction. As shown in FIG. 6, the weight mass center W3-1 is located rearward (rightward in FIG. 6) of the center axis Z1, when viewed from the obverse side in the lateral direction. As indicated by the block arrow Fc in FIG. 6, while the crankshaft 40 is rotating, the centrifugal force is applied to the rear side of the crank weight 45.

As shown in FIG. 5, when viewed from the front side in the longitudinal direction, the eccentric shaft part mass center W2 is located on the center axis Z2 (overlapping with the center axis Z1) of the eccentric shaft part 42. As shown in FIG. 6, when viewed from the obverse side in the lateral direction, the eccentric shaft part 42 is located forward of the main shaft part 41. Therefore, as indicated by the block arrow Fc in FIG. 6, while the crankshaft 40 is rotating, the centrifugal force is applied to the front side of the eccentric shaft part 42.

As shown in FIG. 5, when viewed from the front side in the longitudinal direction, the oil feeding passage mass center W1 is at a location that is a little deviated from the center axis Z1 of the main shaft part 41, according to the inclination direction of the first oil feeding passage 51 (inclined to the obverse side which is the right side in FIG. 5). In FIG. 5, a difference between the oil feeding passage mass center W1 and the center axis Z1 of the main shaft part 41 is expressed as an unbalance radius Ra. As shown in FIG. 6, when viewed from the obverse side in the lateral direction, the first oil feeding passage 51 is not inclined in the lateral direction. The oil feeding passage mass center W1 is located on the center axis Z1.

It is assumed that the balance hole 27 is provided in the rotor 22A as the balance adjustment means which adjusts the unbalanced load caused by the first oil feeding passage 51. As shown in FIG. 5, when viewed from the front side in the longitudinal direction, a "balance hole mass center WO" which is the position of the center of mass of the balance hole 27 is located on the near side relative to the main shaft part 41 (balance hole mass center WO is hidden by the main shaft part 41 in FIG. 5) and is deviated from the center axis Z1 on a side opposite to the oil feeding passage mass center W1 (deviated to the near side which is the left side in FIG. 5).

As shown in FIG. 6, when viewed from the obverse side in the lateral direction, the balance hole 27 is provided in the rotor 22A at a location that is forward of the crankshaft 40. In the example of FIG. 6, the balance hole 27 is the blind hole which opens to the lower side. Therefore, the balance hole mass center WO is located at the lower side of the rotor 22A.

As indicated by the block arrow Fc in FIG. 6, while the crankshaft 40 is rotating, the centrifugal force is applied to the rear side of the rotor 22A, which is opposite to a side (front side) where the balance hole 27 is provided. In the example of FIG. 6, a force (moment) for rotating the upper and lower portions of the crankshaft 40 is reduced, by the centrifugal forces at three locations indicated by the block arrows Fc. This can reduce a force for whirling the crankshaft 40.

Figure 7:
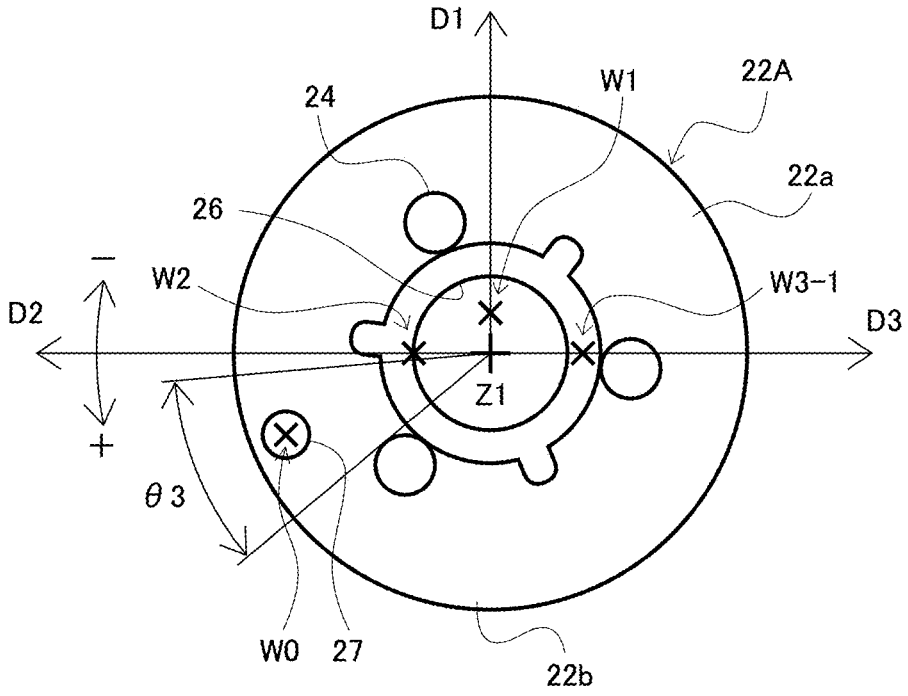
FIG. 7 is a schematic view for explaining a preferable location of the balance hole provided in the rotor secured to the crankshaft of FIGS. 5 and 6.

In a case where the balance weight is the crank weight 45 as described above, the preferable location of the balance hole 27 provided in the rotor 22A is within the sector column region which is in an angular range θ3, as shown in FIG. 7. By providing the balance hole 27 in this angular range θ3, the unbalance radius Ra shown in FIG. 5 can be effectively lessened (reduced or cancelled).

In a case where the rotor 22A is seen from the bottom surface, as shown in FIG. 7, a position relation among the oil feeding passage mass center W1, the eccentric shaft part mass center W2 and the weight mass center W3-1 is the same as that shown in FIG. 4. Also, these three positions of centers of mass, and the balance hole mass center WO have the above-described position relation (see FIGS. 5 and 6). In this case, to lessen the unbalanced load (unbalance radius Ra) caused by the first oil feeding passage 51, the balance hole 27 is more preferably provided in a sector column region which is in a range of 5 to 40 degrees (5 degrees≤θ3≤40 degrees), with respect to the reference line (D2 direction), in the adjustment side semicircular column region 22*b*.

As described above, the plurality of balance holes 27 may be provided in the rotor 22A. In this case, the balance hole mass centers WO of all of the plurality of balance holes 27 should be considered.

As described above, the sealed refrigerant compressor 10A of the present embodiment is preferably inverter-driven with one of a plurality of operating frequencies. As described above, in the inverter drive, a low-speed operation in which the rotational speed of the electric component 20A is reduced and a high-speed operation in which the rotational speed of the electric component 20A is increased are performed. A character frequency of the compressor body 12 elastically supported by the suspension spring 14 is typically close to the low rotational speed of the inverter drive, although this depends on the kind of the sealed refrigerant compressor 10A or the conditions of the inverter drive. Therefore, in many cases, the unbalanced load of the main shaft part 41 caused by the first oil feeding passage 51 during the high-speed operation is negligible as in the conventional example.

Figure 8:
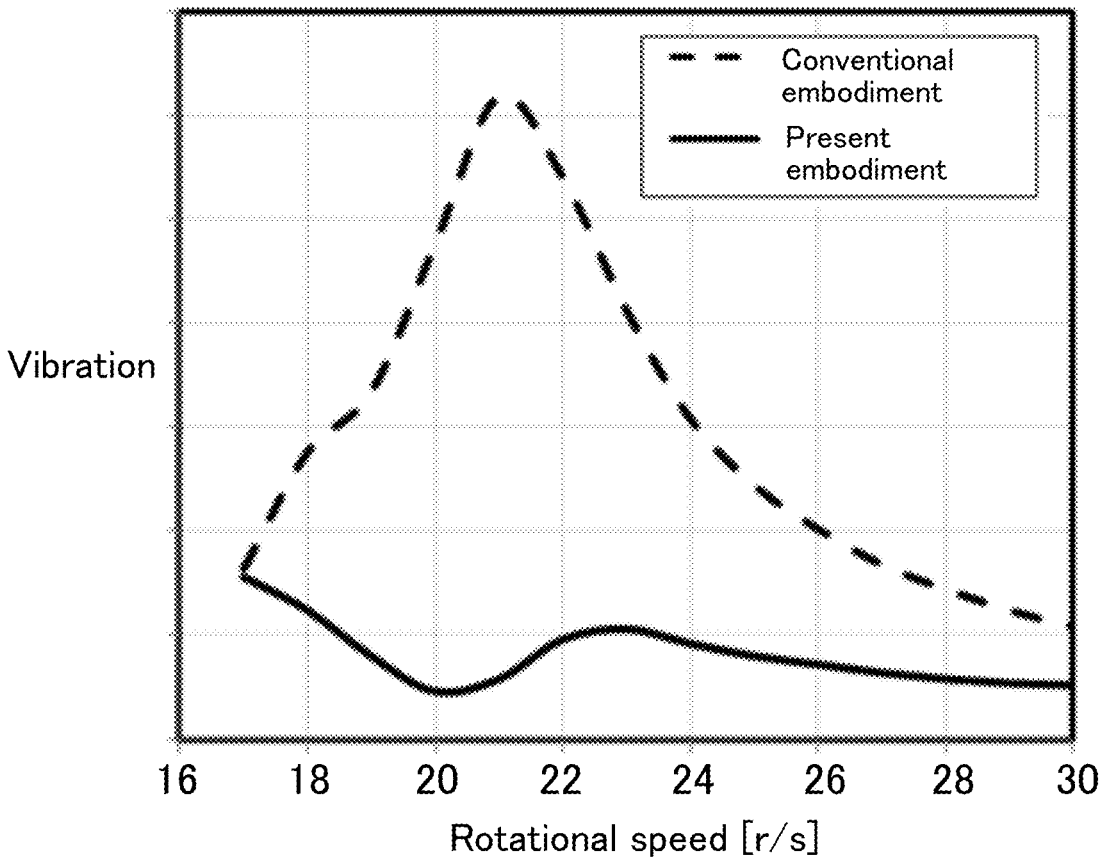
FIG. 8 is a graph showing a relation between a rotational speed and a magnitude of a vibration in a case where each of the sealed refrigerant compressor according to Embodiment 1 and a sealed refrigerant compressor in a conventional example is inverter-driven.

In contrast, during the low-speed operation, the operation frequency is close to the character frequency of the compressor body 12 elastically supported by the suspension spring 14, although this depends on the kind of the sealed refrigerant compressor 10A or the conditions of the inverter drive. Therefore, it has been proved that the unbalanced load occurring in the main shaft part 41 becomes a cause of a vibration, in a case where the unbalanced load occurs in the main shaft part 41 due to the structure of the main shaft part 41. For example, FIG. 8 is a graph showing a result of the operation and a relation between the rotational speed and the vibration during the operation in a case where each of the sealed refrigerant compressor (conventional compressor) of the conventional example and the sealed refrigerant compressor 10A (compressor of the present embodiment) according to the present embodiment is inverter-driven. The compressor of the present embodiment is different from the compressor of the conventional example only in that the balance hole 27 is provided in the rotor 22A.

In this graph, a vertical axis indicates a relative magnitude of the vibration and a horizontal axis indicates the rotational speed (unit: r/s) of the electric component 20A. A broken line indicates a result of the conventional compressor and a solid line indicates a result of the compressor of the present embodiment. In this result of the operation, the rotational speeds in the horizontal axis are numeric values based on the specific constituents included in the conventional compressor and the compressor of the present embodiment. Therefore, the numeric values of the rotational speed are varied in a case where the specific constituents are different and the kind of the compressor is different.

As can be clear from the broken line, in the result of the operation of the conventional compressor, a vibration is not so great, for example, during the rotation of 26 to 30 r/s. However, as the rotational speed is gradually reduced, the magnitude of the vibration becomes a peak when the compressor is rotating at a low speed of about 21 r/s. The unbalanced load of the main shaft part 41 affects this great vibration.

In contrast, in the compressor of the present embodiment, the balance hole 27 is provided in the adjustment side semicircular column region 22*b* of the rotor 22A as described above. Therefore, in the operation of the compressor of the present embodiment, the unbalanced load of the main shaft part 41 is effectively lessened or reduced (or cancelled). As a result, irrespective of whether the operation is the low-speed operation or the high-speed operation, the magnitude of the vibration generated in the compressor of the present embodiment is much smaller than that of the conventional compressor. In particular, the magnitude of the vibration of the compressor of the present embodiment is smaller than that of the vibration of the conventional compressor, in a substantially entire range of the rotational speed in the graph, except that the magnitude of the vibration of the compressor of the present embodiment is almost equal to that of the conventional compressor, at about 17 r/s which is the minimum value of the rotational speed on the graph. The magnitude of the vibration of the compressor of the present embodiment is smallest when the compressor is rotating at a low speed of about 20 r/s. The magnitude of this vibration is almost equal to that of the vibration generated when the compressor is rotating at a high speed of about 30 r/s.

Figure 9:
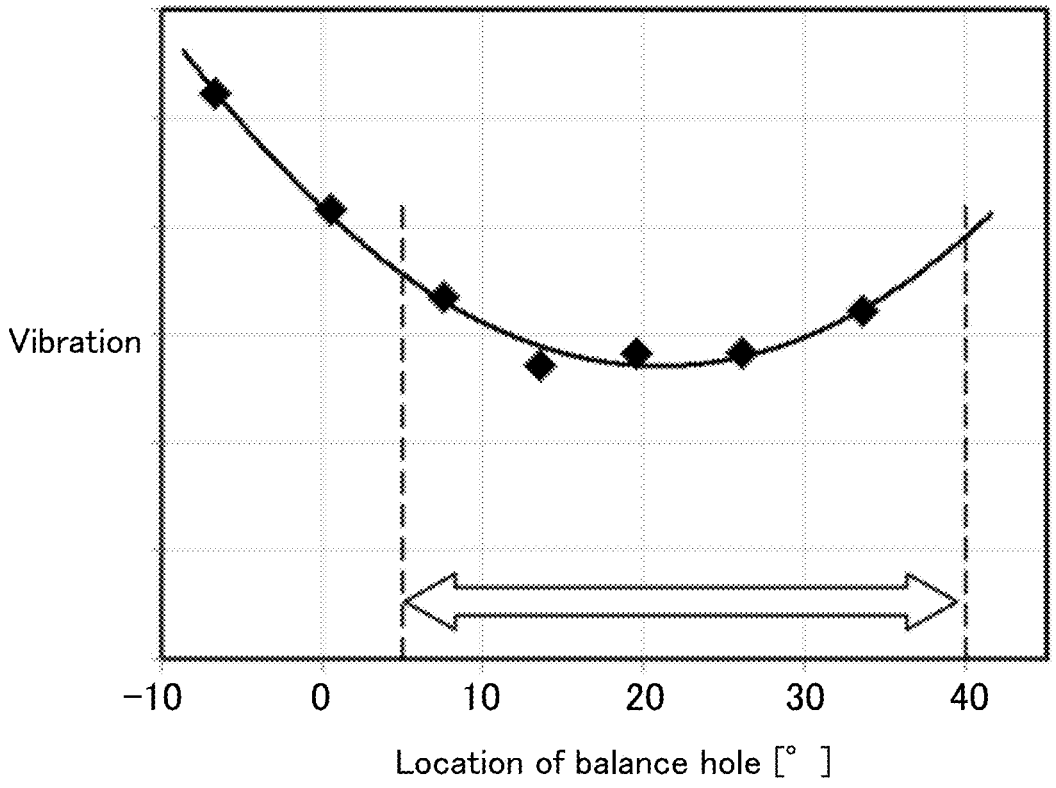
FIG. 9 is a graph showing a relation between a variation in the location of the balance hole and the magnitude of the vibration, in the sealed refrigerant compressor according to Embodiment 1.

FIG. 9 shows the result of study of the location of the balance hole 27 provided in the rotor 22A of the compressor of the present embodiment. In the graph of FIG. 9, a horizontal axis indicates the location of the balance hole 27. FIG. 9 shows the location of the balance hole 27 by a positive or negative angle with respect to the line extending in the D2 direction which is the reference line, as shown in FIG. 7 (and FIG. 4). In the graph of FIG. 9, a vertical axis indicates a relative magnitude of the vibration as in the graph of FIG. 8.

In the graph of FIG. 9, the magnitude of the vibration of the compressor of the present embodiment is observed in a case where the location of the balance hole 27 is varied in a range of −10 degrees to +40 degrees. As can be clearly seen from this graph, in a case where the balance hole 27 is provided in the range of +5 degrees to +40 degrees, namely, within the sector column region which is in a range of θ3 of FIG. 7, the vibration can be sufficiently reduced during the operation of the compressor. From the result of the graph of FIG. 9, it can be found that the vibration is more reduced in the range of +10 degrees to +35 degrees, and is most reduced in the range of +14 degrees to +26 degrees (within a range of 20 degrees±6 degrees). Of course, the vibration can be sufficiently reduced even in a range of 0 degree to +5 degrees, or a range of +40 degrees or larger, although this depends on the conditions which are the constituents of the compressor of the present embodiment and the kind of the compressor.

Figure 10:
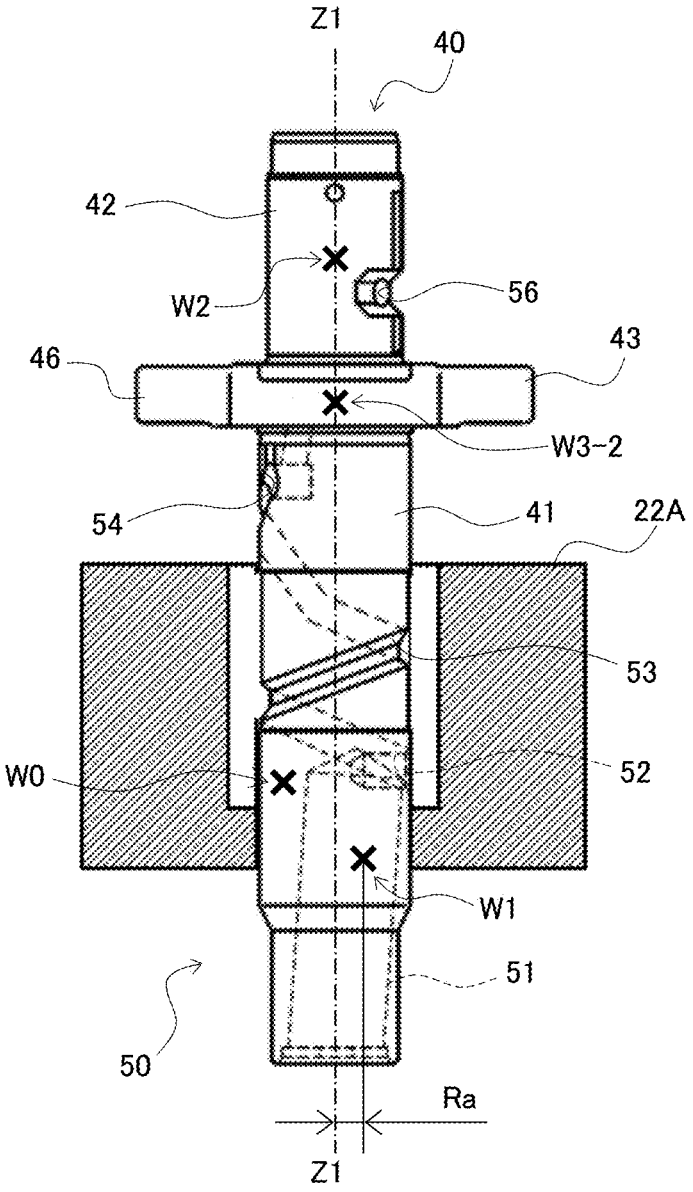
FIG. 10 is a schematic side view showing another example of the positions of the centers of mass in the crankshaft of FIG. 2.
Figure 11:
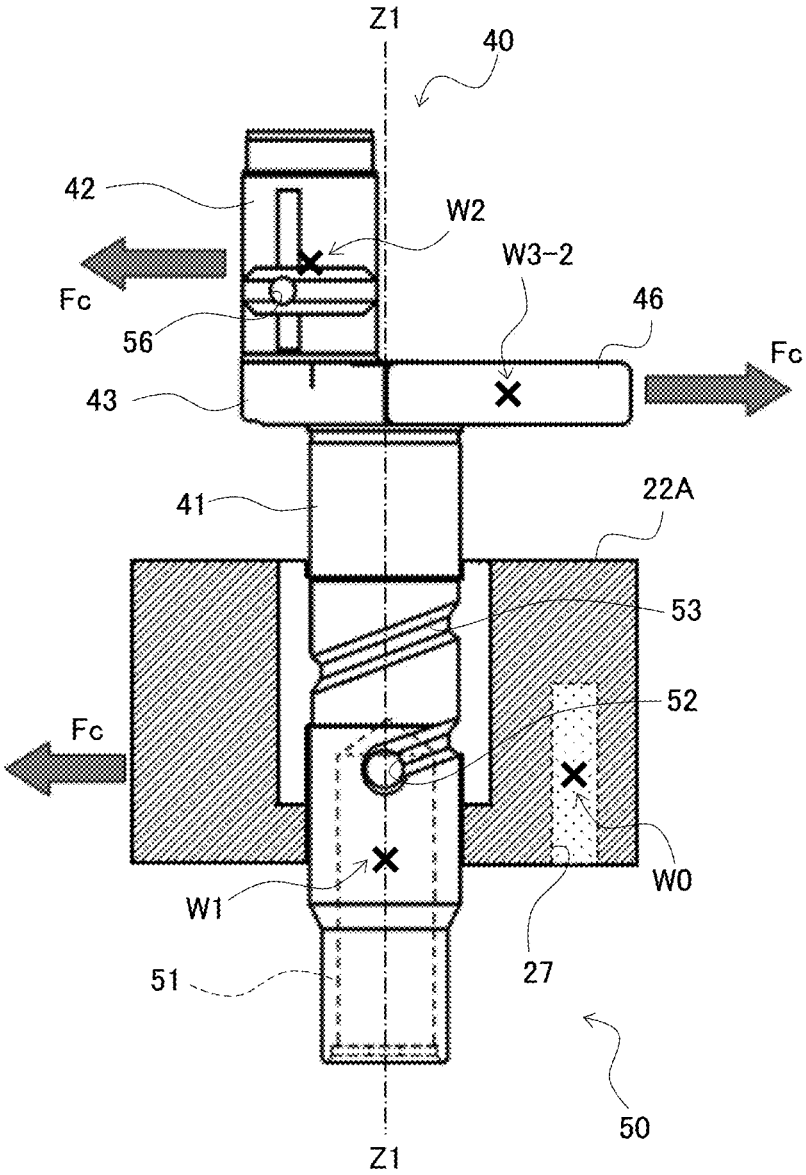
FIG. 11 is a schematic side view showing another example of the positions of the centers of mass in the crankshaft of FIG. 2.

Next, a preferable location of the balance hole 27 in a case where a shaft weight 46 is provided as the balance weight, at the flange part 43 disposed below the eccentric shaft part 42, as shown in FIG. 10 or 11, will be described. FIG. 10 corresponds to the longitudinal side view (left view) of FIG. 2. FIG. 11 corresponds to the lateral side view (right view) of FIG. 2. As in the example of FIGS. 5 and 6, FIGS. 10 and 11 show the rotor 22A as the schematic cross-sectional view and three or four positions of centers of mass by use of X marks. In FIGS. 10 and 11 (and FIG. 12), the weight mass center W3 is expressed as weight mass center W3-2 to make clear that the weight mass center W3 is the position of center of mass (weighted center) of the shaft weight 46.

As shown in FIG. 10, when viewed from the front side in the longitudinal direction, in a case where the balance weight is the shaft weight 46, the eccentric shaft part mass center W2 is located on the center axis Z2 (the center axis Z2 is not shown in FIG. 10 because it overlaps with the center axis Z1) of the eccentric shaft part 42. As shown in FIG. 11, when viewed from the obverse side in the lateral direction, the eccentric shaft part 42 is eccentrically located forward of the main shaft part 41. As indicated by the block arrow Fc in FIG. 11, while the crankshaft 40 is rotating, the centrifugal force is applied to the front side of the eccentric shaft part 42.

As shown in FIG. 10, when viewed from the front side in the longitudinal direction, the weight mass center W3-2 is located on the center axis Z1 of the main shaft part 41 (overlaps with the center axis Z2 of the eccentric shaft part 42), in the flange part 43. As shown in FIG. 11, when viewed from the obverse side in the lateral direction, the weight mass center W3-2 is located rearward (rightward in FIG. 10) of the center axis Z1. As indicated by the block arrow Fc in FIG. 11, while the crankshaft 40 is rotating, the centrifugal force is applied to the rear side of the shaft weight 46.

As shown in FIG. 10, when viewed from the front side in the longitudinal direction, the oil feeding passage mass center W1 is at a location that is a little deviated from the center axis Z1 of the main shaft part 41, according to the inclination direction of the first oil feeding passage 51 (inclined to the obverse side which is the right side in FIG. 10). In FIG. 10, a difference between the oil feeding passage mass center W1 and the center axis Z1 of the main shaft part 41 is expressed as the unbalance radius Ra as in the example of FIG. 5. As shown in FIG. 11, when viewed from the obverse side in the lateral direction, the first oil feeding passage 51 is not inclined in the lateral direction and therefore, the oil feeding passage mass center W1 is located on the center axis Z1.

As shown in FIG. 10, when viewed from the front side in the longitudinal direction, the balance hole 27 is hidden by the main shaft part 41. The balance hole mass center WO is at a location that is a little deviated from the center axis Z1 to a side opposite to the oil feeding passage mass center W1 (deviated to the reverse side which is the left side in FIG. 10), as in the example of FIG. 5. As shown in FIG. 11, when viewed from the obverse side in the lateral direction, the balance hole 27 is provided in the rotor 22A at a location that is rearward of the crankshaft 40. This location is opposite to the location (front location) of the balance hole 27 in a case where the crank weight 45 is provided as shown in FIG. 6.

In the example of FIG. 11, the balance hole 27 is the blind hole which opens to the lower side. The balance hole mass center WO is located at the lower side of the rotor 22A. As indicated by the block arrow Fc in FIG. 11, while the crankshaft 40 is rotating, the centrifugal force is applied to the rear side of the rotor 22A, which is opposite to the side (front side) where the balance hole 27 is provided. In the example of FIG. 11, a force (moment) for rotating the upper and lower portions of the crankshaft 40 is reduced, by the centrifugal forces at three locations indicated by the block arrows Fc. This can reduce a force for whirling the crankshaft 40.

Figure 12:
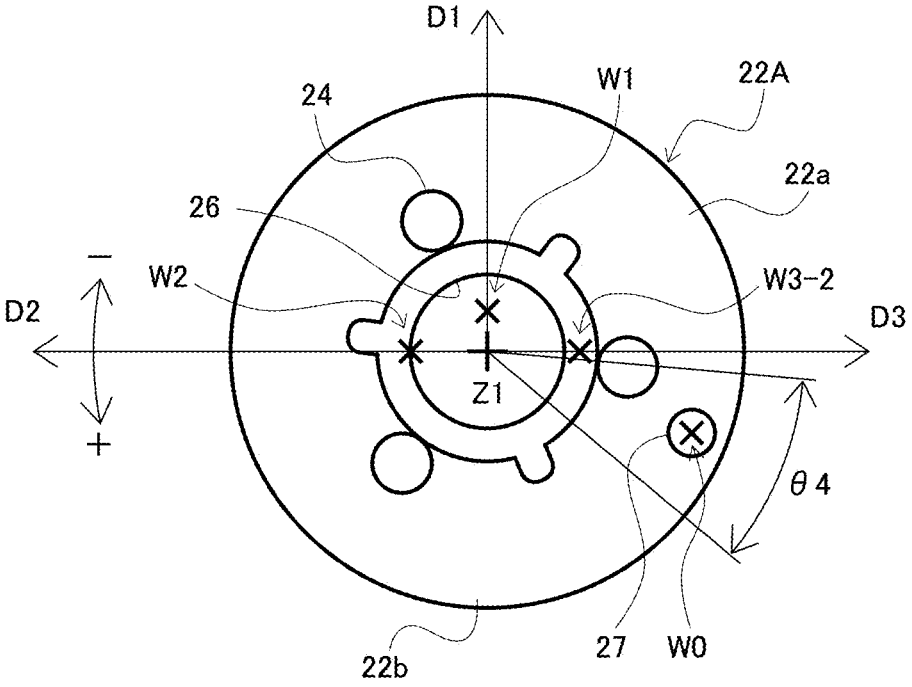
FIG. 12 is a schematic view for explaining a preferable location of the balance hole provided in the rotor secured to the crankshaft of FIGS. 10 and 11.

In a case where the balance weight is the shaft weight 46 as described above, the preferable location of the balance hole 27 provided in the rotor 22A is within the sector column region in an angular range θ4, as shown in FIG. 12. By providing the balance hole 27 in this angular range θ4, the unbalance radius Ra shown in FIG. 10 can be effectively lessened (reduced or cancelled).

In a case where the rotor 22A is seen from the bottom, as shown in FIG. 12, a position relation among the oil feeding passage mass center W1, the eccentric shaft part mass center W2 and the weight mass center W3-2 is the same as that shown in FIG. 4 or FIG. 7. Also, these three positions of centers of mass, and the balance hole mass center WO have the above-described position relation (see FIGS. 10 and 11). In this case, to lessen the unbalanced load (unbalance radius Ra) caused by the first oil feeding passage 51, the balance hole 27 is more preferably provided in a sector column region which is in a range of 140 to 175 degrees (140 degrees≤θ4≤175 degrees), with respect to the reference line (D2 direction), in the adjustment side semicircular column region 22*b*.

In a case where the balance weight is the crank weight 45, the balance hole 27 is preferably provided in the sector column region in an angular range of θ3=5 to 40 degrees (see FIG. 7). In a case where the balance weight is the shaft weight 46, the balance hole 27 is preferably provided in the sector column region in an angular range of θ4=140 to 175 degrees (see FIG. 12). The sector column region in the angular range θ3 and the sector column region in the angular range θ4 have a line-symmetric position relation with respect to a dimeter line extending in the D1 direction.

As described above, in the sealed refrigerant compressor 10A of the present embodiment, it is sufficient that the balance hole 27 is provided as the balance adjustment means which adjusts the unbalanced load caused by the structure of at least the main shaft part 41, in the rotor 22A constituting the electric component 20A. The location of the balance hole 27 is preferably within the adjustment side semicircular column region 22*b* at a location that is opposite to the oil feeding passage mass center W1, with respect to the center axis Z1 of the main shaft part 41 which is located between the oil feeding passage mass center W1 and the balance hole 27.

The angular range of the adjustment side semicircular column region 22*b* will be described. In a case where the radial line (line extending in the D2 direction) extending from the rotation axis (center axis Z1) of the rotor 22A through the eccentric shaft part mass center W2 is the reference line of 0 degree and the angle formed in a region opposite to the oil feeding passage mass center W1 is the positive angle, the angular range θ1 is 0 degree to 180 degrees. The preferable location of the balance hole 27 is within the sector column region in the angular range of θ2=5 degrees to 175 degrees. Further, the preferable location of the balance hole 27 may be within the sector column region in the angular range of θ3=5 degrees to 40 degrees or within the sector column region in the angular range of θ4=140 degrees to 175 degrees, although this depends on the kind (location) of the balance weight provided at the crankshaft 40.

As described above, by providing the balance hole 27 as the balance adjustment means, the unbalanced load caused by the structure of the main shaft part 41 is not adjusted at the main shaft part 41 or the crankshaft 40, but is adjusted at the rotor 22A secured to the main shaft part 41. The rotor 22A has a cylindrical or circular-column shape extending in the direction perpendicular to the axial direction of the crankshaft 40. The balance adjustment means can be easily provided at the rotor 22A, and the location of the balance adjustment means in the rotor 22A can be finely adjusted, compared to a case where the balance adjustment means is provided at the crankshaft 40 or the main shaft part 41 which is elongated and has a small cross-section (diameter). Thus, in the whole of the compressor body 12, the unbalanced load occurring in the main shaft part 41 can be effectively lessened (reduced or cancelled). As a result, further reduction of a vibration of the sealed refrigerant compressor 10A can be realized.

Modified Example

In the sealed refrigerant compressor 10A with the above-described configuration, the balance hole 27 is used as the balance adjustment means. However, the balance adjustment means is not limited to the balance hole 27 and may be a balance weight mounted on the rotor 22A.

Figure 13A:
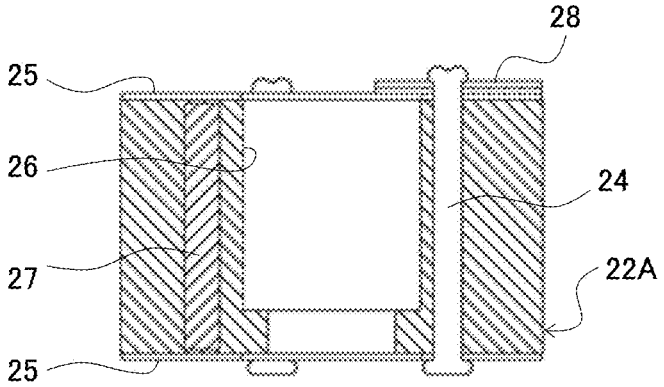
FIGS. 13A and 13B are schematic views showing another example of the rotor and the balance adjustment means of FIGS. 3A to 3C.
Figure 13B:
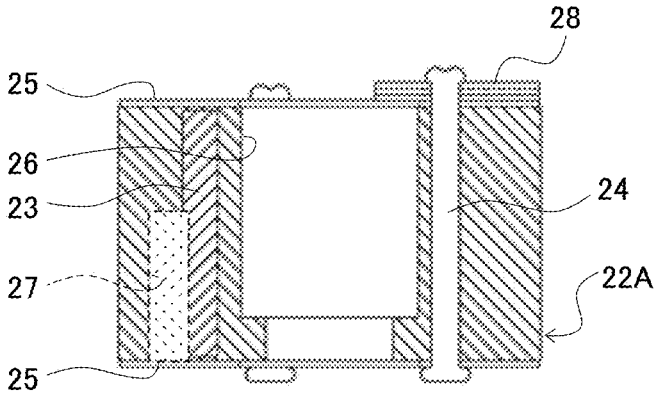

For easier understanding of the description, the balance weight mounted on the rotor 22A will be referred to as "rotor weight", to distinguish this balance weight from the balance weight (the crank weight 45 or the shaft weight 46) mounted on the crankshaft 40. For example, as shown in FIG. 13A or 13B, a rotor weight 28 is secured to the upper surface of the rotor 22A. Alternatively, the rotor weight 28 may be secured to the lower surface of the rotor 22A or to both of the upper surface and lower surface of the rotor 22A.

The location of the rotor weight 28 is not particularly limited. The location of the rotor weight 28 is opposite to the location of the balance hole 27 with respect to the rotation axis (center of rotation) of the rotor 22A which is located between the rotor weight 28 and the balance hole 27.

The balance hole 27 serves to adjust a balance by partially reducing the weight of the rotor 22A. Therefore, as the balance adjustment means, the balance hole 27 may be called "negative balance". In contrast, the rotor weight 28 serves to adjust a balance by partially adding the weight to the rotor 22A. Therefore, as the balance adjustment means, the rotor weight 28 may be called "positive balance". As a result, the location of the rotor weight 28 is opposite to the location of the balance hole 27.

For example, in a case where the balance weight is the crank weight 45 provided at the upper portion of the eccentric shaft part 42 as shown in FIG. 5 or 6, as described above, the balance hole 27 is provided within the sector column region in the angular range of θ3 in the rotor 22A, as shown in FIG. 7. In a case where the rotor weight 28 is used instead of the balance hole 27, the rotor weight 28 may be provided in the sector column region (region in the angular range of θ3) at a location opposite to the location of the crank weight 45, with respect to the center axis Z1 which is the rotation axis of the rotor 22A.

More specifically, in a case where the balance adjustment means is the balance hole 27 as the negative balance, the preferable location of the balance hole 27 is within the semicircular column region of the rotor 22A, namely, the adjustment side semicircular column region 22*b* (within the semicircular column region which is in the angular range of θ1=0 to 180 degrees in FIG. 4), which is opposite to the position of center of mass of the first oil feeding passage 51 with respect to the center axis of the main shaft part 41 located between the position of center of mass of the first oil feeding passage 51 and the location of the balance hole 27. In contrast, in a case where the balance adjustment means is the rotor weight 28 as the positive balance, the preferable location of the rotor weight 28 is within the semicircular column region of the rotor 22A, namely, the mass center side semicircular column region 22*b* (within the semicircular column region which is in the angular range of 180 degrees to 360 degrees in FIG. 4), where the position of center of mass of the first oil feeding passage 51 is present.

As shown in FIG. 13B, as the balance adjustment means, the balance hole 27 and the rotor weight 28 may be used. In the example of FIG. 13B, the balance hole 27 is formed in the iron core as the blind hole which opens in the lower surface, as in the example of FIG. 3B, and the rotor weight 28 is secured to the upper surface of the rotor 22A as in the example of FIG. 13A. As described above, the balance adjustment means may be at least one of the balance hole 27 and the rotor weight 28. Moreover, the balance adjustment means may be other than the balance hole 27 and the rotor weight 28.

In the present disclosure, the balance adjustment means (the balance hole 27 or the rotor weight 28) is preferably provided in the adjustment side semicircular column region 22*b* (the semicircular column region in the angular range of θ1=0 to 180 degrees). However, the location of the balance adjustment means may be limited based on a different condition. For example, in a case where the balance adjustment means is provided at multiple locations, they may be provided in the iron core which is the body of the rotor 22A so that they are not line-symmetric or point-symmetric with respect to the rotation axis (center axis Z1).

Although in the present embodiment, the balance hole 27 is provided in the iron core of the rotor 22A, the balance hole 27 may be provided in a region other than the iron core, depending on the configuration of the rotor 22A. Although in the present embodiment, the balance hole 27 extends along the direction of the rotation axis (center axis Z1 of the main shaft part 41) of the rotor 22A, the configuration of the balance hole 27 is not limited to this.

The specific shape and the like (direction of the hole, diameter of the hole, depth of the hole, through-hole or non-through-hole in the case of the balance hole 27) of the balance adjustment means are not particularly limited so long as the balance adjustment means is capable of balance adjustment for the first oil feeding passage 51, the oil feeding groove 53, or the like which is included in the oil feeding mechanism 50 and causes the unbalanced load in the main shaft part 41. The constituent which causes the unbalanced load in the main shaft part 41 is not limited to the oil feeding passage, the oil feeding groove, or the like of the oil feeding mechanism 50, and may be one of the constituents provided at the main shaft part 41.

In the present embodiment, the first oil feeding passage 51 is inclined with respect to the center axis Z1 of the main shaft part 41. Therefore, a case where the inclination of the first oil feeding passage 51 is a main cause of the unbalanced load occurring in the main shaft part 41 has been described. The present disclosure is not limited to this. The first oil feeding passage 51 may not be inclined in a case where the position of the oil feeding passage mass center W1 is deviated from the center axis Z1 of the main shaft part 41.

As described above, the cause of the unbalanced load is the oil feeding groove 53, the first communication hole 52, the oil feeding hole 54, and others as well as the first oil feeding passage 51. The position of the oil feeding passage mass center W1 can be set in view of deviations of the centers of mass of the oil feeding groove 53, the first communication hole 52, and the oil feeding hole 54, as well as the center of mass of the first oil feeding passage 51. In a case where the oil feeding passage mass center W1 is deviated from the center axis Z1 in the whole of the main shaft part 41, the unbalanced load occurring in the main shaft part 41 can be effectively lessened (reduced or cancelled) by providing the balance adjustment means such as the balance hole 27 or the rotor weight 28 at the rotor 22A.

Embodiment 2

Figure 14:
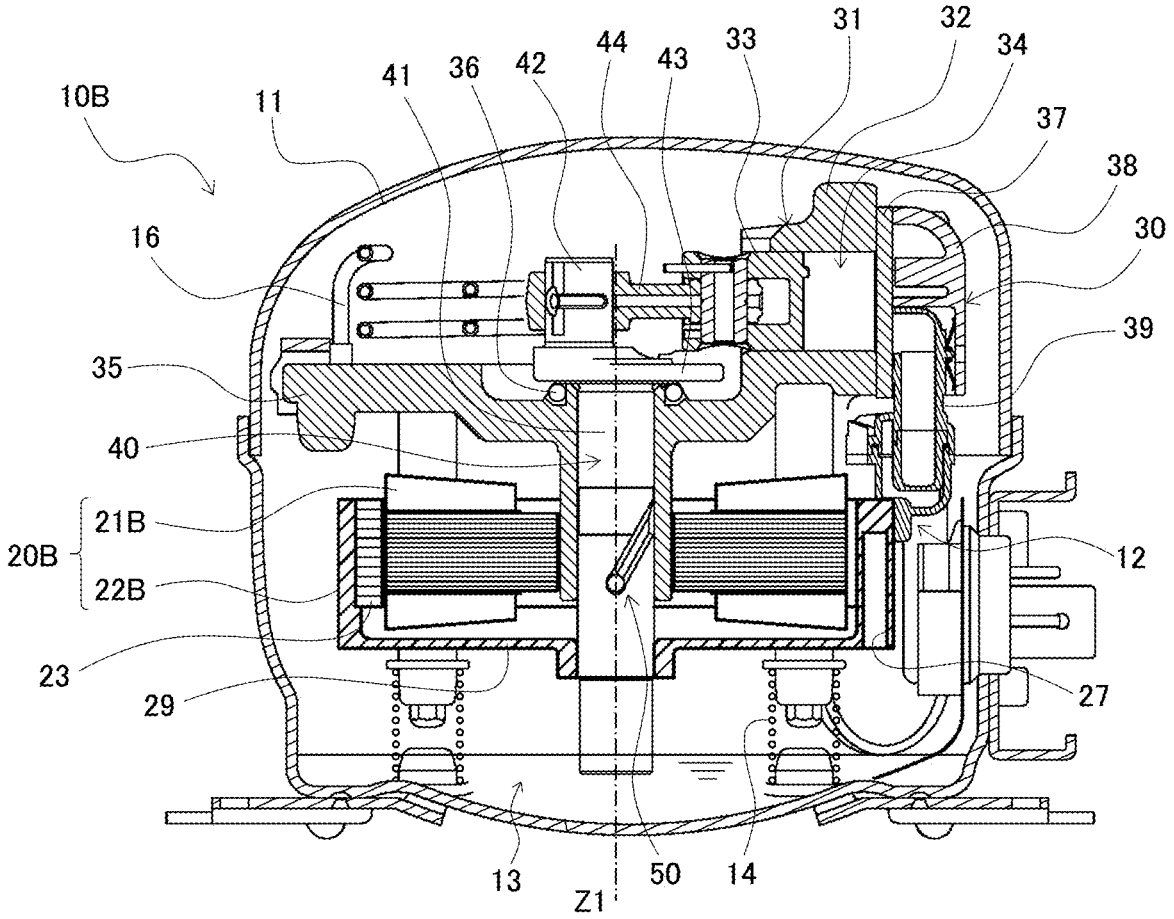
FIG. 14 is a cross-sectional view showing an example of the configuration of a sealed refrigerant compressor according to Embodiment 2 of the present disclosure.

In the sealed refrigerant compressor 10A according to Embodiment 1, the electric component 20A is the inner rotor motor. The present disclosure is not limited to this. The electric component may be an outer rotor motor. Specifically, as shown in FIG. 14, as in the sealed refrigerant compressor 10A according to Embodiment 1, a sealed refrigerant compressor 10B according to Embodiment 2 includes an electric component 20B and the compression component 30 (compressor body 12) accommodated in the sealed container 11, and the refrigerant gas and the lubricating oil 13 are reserved in the sealed container 11. The electric component 20B is the outer rotor motor.

As in the electric component 20A according to Embodiment 1, the electric component 20B includes at least a stator 21B and a rotor 22B. As shown in a top plan view of FIG. 15A or a longitudinal sectional view of FIG. 15B, the stator 21B has the shaft insertion hole 26 in a center portion thereof. The bearing unit 35 of the compression component 30 is pressed into the shaft insertion hole 26.

Figure 15A:
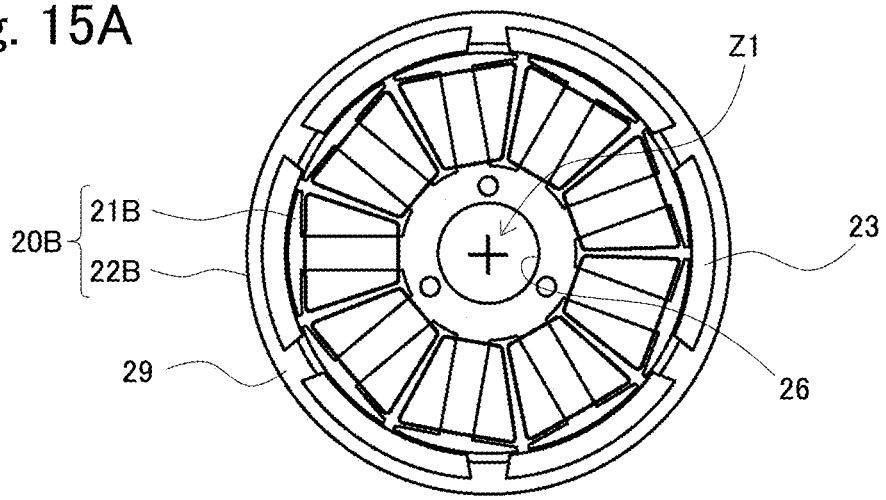
FIGS. 15A to 15C are views showing another example of the configuration of an electric component included in the sealed refrigerant compressor of FIG. 14.
Figure 15B:
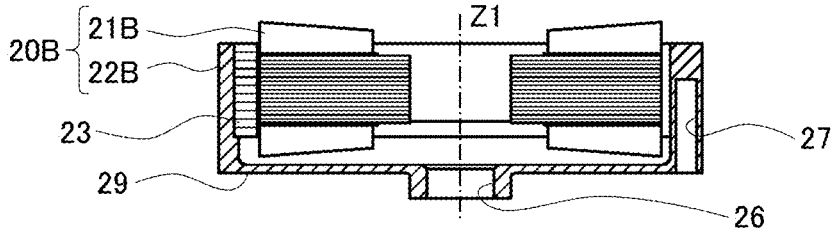

As shown in FIGS. 14, 15A and 15B, the rotor 22B is disposed coaxially with the stator 21B and surrounds the outer periphery of the stator 21B. The rotor 22B has a length in the rotation axis direction (center axis Z1 direction) smaller than the diameter of the rotor 22B. In brief, the rotor 22B of Embodiment 2 has a large diameter and is short in the longitudinal direction, as in the rotor 22A of Embodiment 1.

In the rotor 22B, the permanent magnets 23 are uniformly arranged at the inner periphery of a cylindrical yoke 29 which is rotatable around the outer periphery of the stator 21B. The yoke 29 may be a disc shape with a diameter larger than that of the flange part 43. Or, the cylindrical yoke 29 may be secured to the outer periphery of a frame with a diameter larger than that of the flange part 43. As shown in FIG. 15B and the bottom view of FIG. 15C, the shaft insertion hole 26 is formed in the center of the yoke 29 (or frame) of the rotor 22B. This shaft insertion hole 26 is secured to the lower end of the main shaft part 41 of the crankshaft 40 by welding, or the like.

The sealed refrigerant compressor 10B of the present embodiment is the same as the sealed refrigerant compressor 10A (see FIG. 1) according to Embodiment 1 except that the electric component 20B is the outer rotor motor. Therefore, specific description of the sealed refrigerant compressor 10B is omitted. Although in FIG. 14, the suction pipe 15 is not shown for easier illustration, the sealed refrigerant compressor 10B of the present embodiment includes the suction pipe 15 as in the sealed refrigerant compressor 10A of FIG. 1 according to Embodiment 1. Although the permanent magnets 23 included in the rotor 22A are not shown in FIG. 1, the permanent magnets 23 included in the rotor 22B are shown in FIG. 14.

The operation of the sealed refrigerant compressor 10B is basically the same as that of the sealed refrigerant compressor 10A. When electric power is supplied to the electric component 20B, a current flows through the stator 21B and a magnetic field is generated, which causes the rotor 22B secured to the main shaft part 41 of the crankshaft 40 to rotate. According to the rotation of the rotor 22B, the crankshaft 40 rotates. The rotation of the crankshaft 40 is transmitted to the piston 33 via the connecting rod 44 which is rotatably mounted on the eccentric shaft part 42, and thereby the piston 33 reciprocates inside the cylinder 32. Thus, the refrigerant gas is compressed by the compression component 30.

As in the sealed refrigerant compressor 10A according to Embodiment 1, in the sealed refrigerant compressor 10B of the present embodiment, the balance hole 27 as the balance adjustment means is formed in the rotor 22B included in the electric component 20B. In the rotor 22B of the present embodiment, the iron core as the body is formed as the yoke 29, and the permanent magnets 23 are provided at the inner peripheral surface of this yoke 29. Therefore, the electric component 20B is SPM motor. The rotor 22B does not include magnet protective members covering the surfaces (inner peripheral surfaces) of the permanent magnets 23 (the rotor 22B does not require the magnet protective members for covering the permanent magnets 23).

Figure 15C:
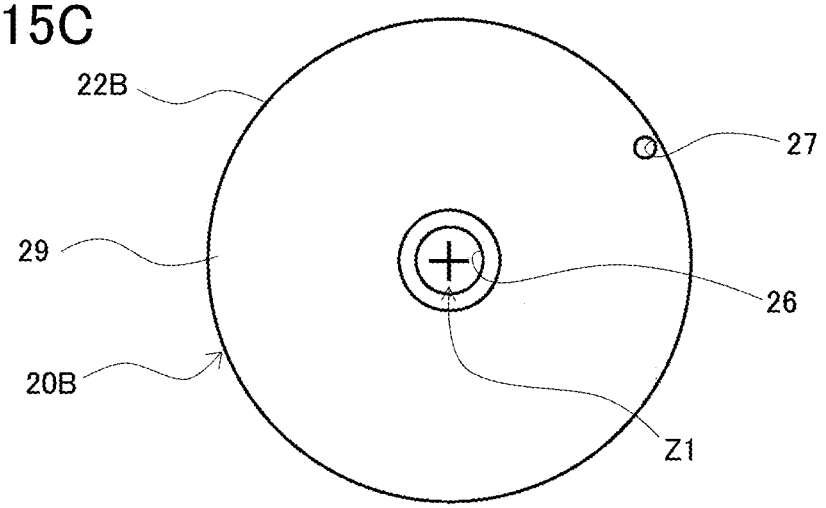

As shown in FIGS. 14 and 15B, the balance hole 27 extends along the center axis Z1 of the rotor 22B. In Embodiment 2, as shown in FIGS. 15A and 15C, the balance hole 27 is provided at a location that is in the vicinity of the outer periphery of the rotor 22B, in the top plan view or bottom view of the rotor 22B. At least a portion of the balance hole 27 is provided at a location that is outward of the permanent magnets 23, when viewed from the center axis Z1 of the rotor 22B. The specific location of the balance hole 27 is not particularly limited.

The specific configuration of the balance hole 27 has been described in Embodiment 1. Specifically, the balance hole 27 may be provided within a semicircular column region (see the adjustment side semicircular column region 22*b* in FIG. 4) of the rotor 22B, which is located on a side opposite to the position (oil feeding passage mass center W1) of center of mass of the first oil feeding passage 51, with respect to the center axis Z1 of the main shaft part 41 which is located between the balance hole 27 and the oil feeding passage mass center W1.

The balance hole 27 may be provided within a sector column region (region in the angular range of θ2 in FIG. 4) in a range of 5 to 175 degrees with respect to the reference line, in the semicircular column region. Further, the balance hole 27 may be provided within at least one of a sector column region (region in the angular range of θ3 in FIG. 7) in a range of 5 degrees to 40 degrees with respect to the reference line, and a sector column region (region in the angular range of θ4 in FIG. 11) in a range of 140 degrees to 175 degrees with respect to the reference line.

In the sealed refrigerant compressor 10B including the electric component 20B of the outer rotor type, by providing the balance hole 27 as the balance adjustment means, the unbalanced load caused by the structure of the main shaft part 41 is not adjusted in the main shaft part 41 or the crankshaft 40 and adjusted in the rotor 22B secured to the main shaft part 41. Thus, in the whole of the compressor body 12, the unbalanced load occurring in the main shaft part 41 can be effectively lessened (reduced or cancelled). As a result, further reduction of a vibration of the sealed refrigerant compressor 10B can be realized.

Embodiment 3

In Embodiment 3, an example of a refrigeration device including the sealed refrigerant compressor 10A of Embodiment 1 or the sealed refrigerant compressor 10B of Embodiment 2 will be described with reference to FIG. 16.

The sealed refrigerant compressor 10A or 10B of the present disclosure can be suitably incorporated into a refrigeration cycle or various devices (refrigeration devices) having a configuration similar to that of the refrigeration cycle. Specifically, for example, the devices may be a refrigerator (refrigerator for household use or refrigerator for business purpose), an ice making machine, a show case, a dehumidifier, a heat pump type hot water supply device, a heat pump type laundry/drying machine, an automatic vending machine, an air conditioner, an air compressor, etc. However, these are merely exemplary. In the present embodiment, the basic configuration of a refrigeration device 60 will be described in conjunction with an article storage device of FIG. 16, as an exemplary device into which the sealed refrigerant compressor 10A or 10B is incorporated.

Figure 16:
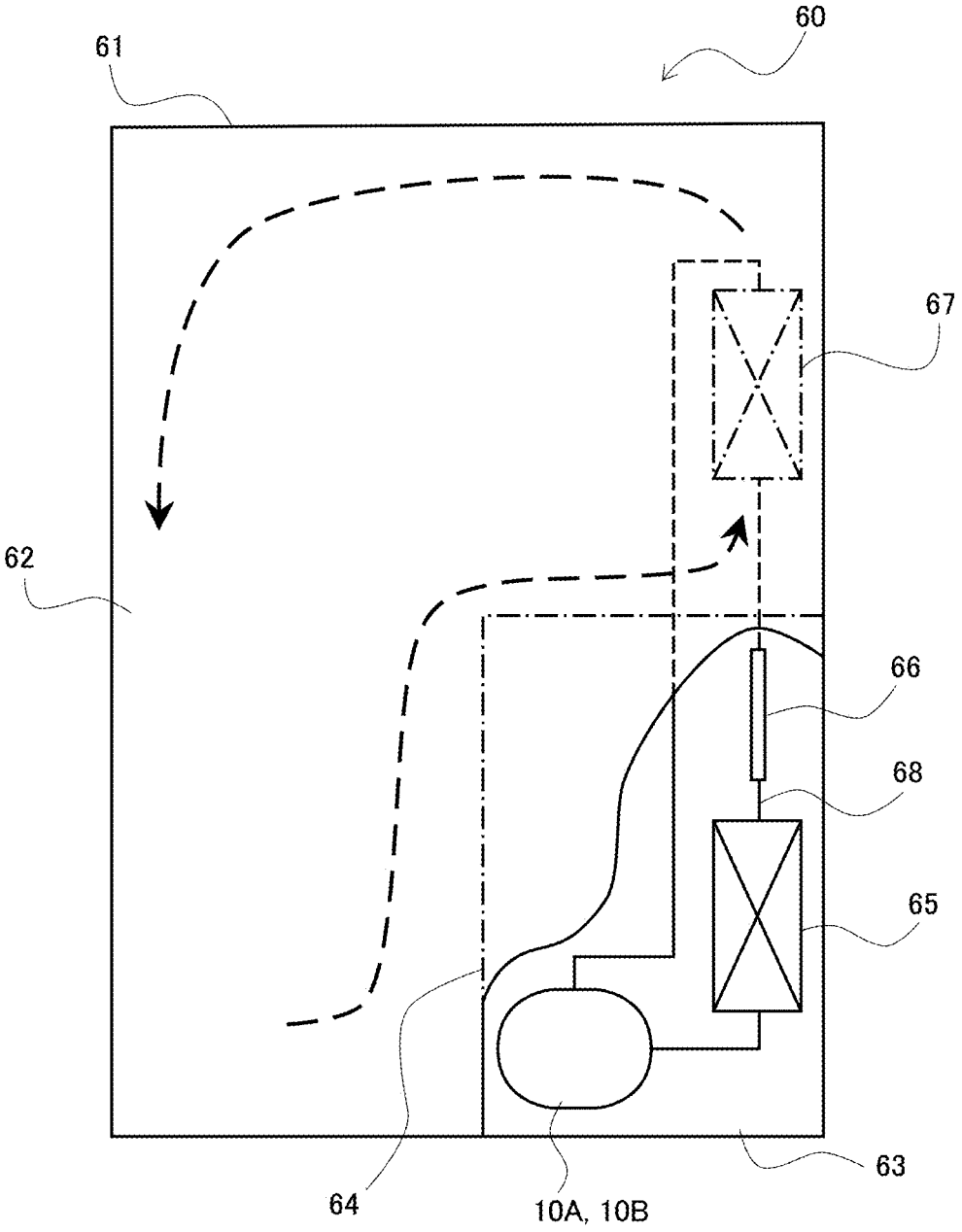
FIG. 16 is a schematic view showing an example of the configuration of an article storage device which is a refrigeration device according to Embodiment 3 of the present disclosure.

The refrigeration device 60 of FIG. 16 includes a refrigeration device body 61 and a refrigerant circuit. The refrigeration device body 61 includes a heat insulating casing having an opening and a door which opens and closes the opening of the casing. The refrigeration device body 61 includes in the interior thereof a storage space 62 for storing articles, a mechanical room 63 for storing the refrigerant circuit and the like, and a partition wall 64 which defines the storage space 62 and the mechanical room 63.

The refrigerant circuit has a configuration in which the sealed refrigerant compressor 10A of Embodiment 1 or 10B of Embodiment 2, a heat radiator 65, a pressure-reducing device 66, a heat absorbing unit 67, and the like are connected together in an annular shape by use of a pipe 68. In brief, the refrigerant circuit is an exemplary refrigeration cycle using the sealed refrigerant compressor 10A or 10B of the present disclosure.

In the refrigerant circuit, the sealed refrigerant compressor 10A or 10B, the heat radiator 65, and the pressure-reducing device 66 are placed in the mechanical room 63, while the heat absorbing unit 67 is placed in the storage space 62 including a blower (not shown in FIG. 16). As indicated by a broken line arrow, the blower agitates cold heat of the heat absorbing unit 67 to circulate it in the interior of the storage space 62.

In the above-described manner, the refrigeration device 60 of the present embodiment incorporates the sealed refrigerant compressor 10A of Embodiment 1 or the sealed refrigerant compressor 10B according to Embodiment 2. In the sealed refrigerant compressor 10A or 10B of the present disclosure, as described above, the rotor 22A or 22B is provided with the balance adjustment means which adjusts the unbalanced load due to the structure of at least the main shaft part 41, for example, the balance hole 27.

In this configuration, in the sealed refrigerant compressor 10A or 10B, the unbalanced load of the main shaft part 41 can be effectively lessened or cancelled, in the whole of the compressor body 12. As a result, the sealed refrigerant compressor 10A or 10B can realize further reduction of a vibration. Since the refrigerant circuit is operated by the sealed refrigerant compressor 10A or 10B, the refrigeration device 60 can realize further reduction of a vibration.

The present invention is not limited to the above embodiments. Various modifications may be made within the scope of the claims. An embodiment obtained by suitably combining technical means disclosed in different embodiments and a plurality of modification examples is included in the technical scope of the present invention.

INDUSTRIAL APPLICABILITY

As described above, the present invention can be widely suitably used in the fields of sealed refrigerant compressor constituting the refrigeration cycle. Further, the present invention can be widely used in the fields of refrigeration devices incorporating the sealed refrigerant compressor, such as refrigeration devices for household uses such as electric freezers/refrigerators or air conditioners, or refrigeration devices for business purposes such as a dehumidifier, a show case for business purpose or an automatic vending machine, etc.

REFERENCE SIGNS LIST

10A, 10B sealed refrigerant compressor
11 sealed container
12 compressor body
13 lubricating oil
20A, 20B electric component
21A, 21B stator
22A, 22B rotor
23 permanent magnet
27 balance hole (balance adjustment means)
28 rotor weight (balance adjustment means, balance weight)
30 compression component
31 cylinder block
32 cylinder
33 piston
34 compression chamber
35 bearing unit
40 crankshaft
41 main shaft part
42 eccentric shaft part
43 flange part
44 connecting rod
45 crank weight (balance weight)
46 shaft weight (balance weight)
50 oil feeding mechanism
51 first oil feeding passage
52 first communication hole
53 oil feeding groove
54 oil feeding hole
55 second oil feeding passage
56 second communication hole
60 refrigeration device

The invention claimed is:

1. A sealed refrigerant compressor comprising:

a crankshaft including a main shaft part, an eccentric shaft part and an oil feeding passage, the main shaft part having a center axis, the eccentric shaft part having a position of center of mass which is offset from the center axis of the main shaft part, the oil feeding passage having a part that is formed as a hole extending upwards from an end surface of a lower end portion of the main shaft and is inclined with respect to the center axis of the main shaft part such that the oil feeding passage has a position of center of mass which is offset from the center axis of the main shaft part in a direction substantially perpendicular to a direction of the offset of the position of the center of mass of the eccentric shaft part from the center axis of the main shaft part, a cylinder a piston coupled to the eccentric shaft part and being reciprocatable inside the cylinder, and a rotor provided with a balance hole which adjusts an unbalanced load caused by a structure of the main shaft part, wherein the balance hole is provided in a semicircular column region of the rotor which is located on a side opposite to the position of center of mass of the oil feeding passage, with respect to the center axis of the main shaft part which is located between the balance hole and the position of center of mass of the oil feeding passage wherein in a case where a radial line extending from a rotation axis of the rotor through the position of center of mass of the eccentric shaft part is a reference line of 0 degree, and an angle formed in a region on the side opposite to the position of center of mass of the oil feeding passage is a positive angle, the balance hole is provided within a sector column region in a range of 5 to 175 degrees with respect to the reference line, in the semicircular column region of the rotor.

2. The sealed refrigerant compressor according to claim 1, wherein the rotor further includes a balance weight.

3. The sealed refrigerant compressor according to claim 1, wherein the hole is provided within at least one of a sector column region in a range of 5 to 40 degrees with respect to the reference line and a sector column region in a range of 140 to 175 degrees with respect to the reference line, in the semicircular column region of the rotor.

4. The sealed refrigerant compressor according to claim 1, wherein the balance hole is provided in an iron core of the rotor.

5. The sealed refrigerant compressor according to claim 1, wherein the balance hole extends along a direction of a rotation axis of the rotor.

6. The sealed refrigerant compressor according to claim 1, wherein the balance hole is a blind hole with a bottom surface or a through-hole.

7. The sealed refrigerant compressor according to claim 1, wherein the balance hole adjusts an unbalanced load generated by a reciprocating motion of the piston in addition to the unbalanced load caused by the structure of the main shaft part.

8. A refrigeration device comprising:

the sealed refrigerant compressor according to claim 1.

* * * * *